US009396653B2

(12) United States Patent
Ni

(10) Patent No.: US 9,396,653 B2
(45) Date of Patent: Jul. 19, 2016

(54) METHOD AND SYSTEM FOR TRAFFIC RESOURCES ALLOCATION

(71) Applicant: Jiantong Ni, Guangzhou (CN)

(72) Inventor: Jiantong Ni, Guangzhou (CN)

(73) Assignee: AEIO GROUP INC., Tortola (VG)

( * ) Notice: Subject to any disclaimer, the term of this patent is extended or adjusted under 35 U.S.C. 154(b) by 0 days.

(21) Appl. No.: 14/100,293

(22) Filed: Dec. 9, 2013

(65) Prior Publication Data

US 2014/0097969 A1 Apr. 10, 2014

Related U.S. Application Data

(63) Continuation-in-part of application No. 13/486,314, filed on Jun. 1, 2012, now Pat. No. 8,629,785.

(51) Int. Cl.

| | |
|---|---|
| ***G08G 1/00*** | (2006.01) |
| ***G08G 1/07*** | (2006.01) |
| ***G08G 1/081*** | (2006.01) |

(52) U.S. Cl.
CPC . *G08G 1/07* (2013.01); *G08G 1/081* (2013.01)

(58) Field of Classification Search
CPC ..... G08G 1/07; G08G 1/081
USPC ..... 340/901, 905, 907, 909, 916, 917, 918; 701/2, 113, 117
See application file for complete search history.

(56) References Cited

U.S. PATENT DOCUMENTS

| | | | | |
|---|---|---|---|---|
| 5,940,010 | A * | 8/1999 | Sasaki et al. | 340/901 |
| 7,663,505 | B2 * | 2/2010 | Publicover | 340/932 |
| 7,860,639 | B2 * | 12/2010 | Yang | 701/117 |
| 8,279,086 | B2 * | 10/2012 | Liu et al. | 340/909 |
| 8,532,843 | B2 * | 9/2013 | Nagura et al. | 701/2 |

* cited by examiner

*Primary Examiner* — Van Trieu
(74) *Attorney, Agent, or Firm* — Cislo & Thomas, LLP; Kelly W. Cunningham, Esq.

(57) ABSTRACT

A traffic lane control method for controlling lane traffic around an intersection is provided. The method includes dividing a road into one or more lanes. The method also includes providing a control line with a traffic light system or a lane control light system. Further, the method includes providing a control area with a pre-determined length before or after the control line in the direction of the traffic. The method also includes controlling traffic movement on the road by permitting a vehicle on one or more lanes to pass the control line, and controlling a traffic movement on the road by prohibiting a vehicle on other lane to pass the control line.

19 Claims, 34 Drawing Sheets

2300

300

300

400

| Traffic Direction | Phase 1 | Phase 2 | Phase 3 |
|---|---|---|---|
| BL | N | N | Y |
| BR | N | Y | N |
| XT | Y | N | N |
| XL | N | Y | N |
| YT | Y | N | N |
| YR | N | N | Y |

Fig. 29

METHOD AND SYSTEM FOR TRAFFIC RESOURCES ALLOCATION

CROSS REFERENCE TO RELATED APPLICATIONS

This application is a continuation-in-part of U.S. patent application Ser. No. 13/486,314, filed on Jun. 1, 2012, and issued as U.S. Pat. No. 8,629,785 on Jan. 14, 2014, the entire contents of which are hereby incorporated by reference.

FIELD OF INVENTION

The invention relates to traffic control technologies in general and, more particularly, to methods and systems for traffic resource allocation at an intersection.

BACKGROUND

To ensure safety and efficiency of transportation, the traffic must be organized, especially in cities and towns where there is large volume of traffic needs. The control of traffic at intersections, where two or more roads either meet or cross, is essential to the organization of traffic in populated areas. The control is usually achieved by a signal-controlled system to allocate the time to indicate which traffic is allowed to proceed using traffic signals, usually electric. The performance of such system is responsible for the safety and efficiency of traffic in cities and towns.

FIG. 1 shows a traditional traffic allocation system 100. As shown in FIG. 1, when two roads AB and XY intersect, traffic needs to be controlled along four directions: AB, BA, XY, and YX. For each traffic direction, there are both through traffic and turn traffic (including left turn, right turn, and U turn). Thus, for two four-lane roads, AB and XY, with two lanes at each direction crossing at an intersection, the traditional system 100 allocates through traffic and right turn traffic to the curb lane using a through and right turn traffic marking 102, and through traffic and left turn traffic to the inner lane using a through and left turn traffic marking 104.

In addition to the allocation of space in terms of lanes, FIG. 2 shows an allocation of passing permit in the AB and XY intersection. As shown in FIG. 2, the traditional system uses four phases to direct the traffic movement in the intersection. Each traffic signal is represented by a number of letters and numbers, from left to right. The first letter (A, B, X, Y) represents the road on which the traffic signal controls the traffic movement. The second number indicates a traffic pattern, with number one ("1") indicating a through traffic, and number two ("2") indicating various turn traffics. The third letter, which follows the number (e.g., 2), further indicates the direction of the turn traffic, with U meaning U turn, L meaning left turn, and R meaning right turn. For example, A1 controls the through traffic on Road A, and X2L controls the left turn traffic on Road X.

There are 4 phases of traffic passing permit as shown in FIG. 2. During the first phase, the lights controlling the various traffics from Road A (A1, A2U, A2L, A2R) are green and other lights are red. During the second phase, the lights controlling the various traffics from Road B (B1, B2U, B2L, B2R) are green and other lights are red. During the third phase, the lights controlling the various traffics from Road X (X1, X2U, X2L, X2R) are green and other lights are red. During the fourth phase, the lights controlling the various traffics from Road Y (Y1, Y2U, Y2L, Y2R) are green and other lights are red. FIGS. 3-6 illustrate traffic movements corresponding to the various phases. Although the U turn traffic is also included in FIG. 2, U turn traffic is in general not permitted in a two-lane setting and is thus omitted in FIGS. 3-6.

FIG. 3 illustrates the traffic movements in the first phase of the traditional system, including pedestrian traffic 108, vehicle through traffic 110, vehicle right turn traffic 112, and vehicle left turn traffic 114. A1, A2, B1, B2, X1, X2, Y1, and Y2 are the traffic lights in the system for corresponding lanes. All the vehicle traffics on Road A, including the through traffic 110, and turn traffic 112 and 114, are permitted to proceed, while no vehicle is permitted to pass through the intersection from other roads. The pedestrian traffics 108 on both Roads AB and XY are possible but limited to half of the pedestrian crossing line 106 and the pedestrians are forced to stop in the middle of the cross line to avoid conflict with passing vehicles. Traffic accident is likely to occur if pedestrian proceeds into the vehicle pathway 112 or 114. Thus, both the pedestrian and the driver in the turning vehicle would have to reduce their speed to observe other traffics to avoid accident. In some jurisdictions, vehicles on Road B, X and Y are allowed to turn right even under the red light, further increasing the risk of collision between vehicles and pedestrians.

FIG. 4 illustrates the traffic movements in the second phase of the traditional system, including pedestrian traffic 108, vehicle through traffic 110, vehicle right turn traffic 112, and vehicle left turn traffic 114. All the vehicle traffic on Road B, including the through traffic 110 and turn traffic 112 and 114, are permitted to proceed, while no vehicle is permitted to pass through the intersection from other roads. The pedestrian traffics 108 on both Roads AB and XY are possible but limited to half of the pedestrian crossing lines 106 and the pedestrians are forced to stop in the middle of the cross line to avoid conflict with passing vehicles. Traffic accident is likely to occur if pedestrian proceeds into the vehicle pathway 112 or 114. Thus, both the pedestrian and the driver in the turning vehicle would have to reduce their speed to observe other traffics to avoid accident. In some jurisdictions, vehicles on Road A, X and Y are allowed to turn right even under the red light, further increasing the risk of collision between vehicle and pedestrian.

FIG. 5 illustrates the traffic movements in the third phase of the traditional system, including pedestrian traffic 108, vehicle through traffic 110, vehicle right turn traffic 112, and vehicle left turn traffic 114. All the vehicle traffics on Road X, including the through traffic 110 and turn traffic 112 and 114, are permitted to proceed, while no vehicle is permitted to pass through the intersection from other roads. The pedestrian traffics 108 on both Roads AB and XY are possible but limited to half of the pedestrian crossing lines 106 and the pedestrians are forced to stop in the middle of the cross lines to avoid conflict with passing vehicles. Traffic accident is likely to occur if pedestrian proceeds into the vehicle pathway 112 or 114. Thus, both the pedestrian and the driver in the turning vehicle would have to reduce their speed to observe other traffics to avoid accident. In some jurisdictions, vehicles on Road A, B and Y are allowed to turn right even under the red light, further increasing the risk of collision between vehicle and pedestrian.

FIG. 6 illustrates the traffic movements in the fourth phase of the traditional system, including pedestrian traffic 108, vehicle through traffic 110, vehicle right turn traffic 112, and vehicle left turn traffic 114. All the vehicle traffics on Road Y, including the through traffic 110, and turn traffic 112 and 114, are permitted to proceed, while no vehicle is permitted to pass through the intersection from other roads. The pedestrian traffics 108 on both Roads AB and XY are possible but limited to half of the pedestrian crossing lines 106 and the pedestrians are forced to stop in the middle of the cross line to avoid conflict with passing vehicles. Traffic accident is likely to occur if pedestrian proceeds into the vehicle pathway 112 or 114. Thus, both the pedestrian and the driver in the turning vehicle would have to reduce their speed to observe other traffics to avoid accident. Therefore, there are conflicts in all of the four phases of traffic movements.

FIG. 7 illustrates another traditional traffic system 200. As shown in FIG. 7, Road AB is now an eight-lane road, with four lanes for each direction. The curb lane (the right lane) is used for right turn traffic with a right turn marking 116; the innermost lane is used for left turn and U turn with a left and U turn marking 120; and the two inner lanes between the curb lane and innermost lane are used for through traffic with a through traffic markings 118. That is, if there are three or more lanes (Road AB), left turn traffic may take the left lane, right turn traffic may take the right lane, and through traffic may take the middle lane(s). For a two-lane road, U turn traffic is generally not permitted.

The same problems of traffic movement conflicts as previously described similarly exist in the traditional system 200 as shown in FIG. 7. For example, when the traffic on Road A is permitted to proceed, the through traffic, left turn traffic, right turn traffic, and U turn traffic are permitted to proceed, while no vehicle is permitted to pass through the intersection from other roads. The pedestrian traffics on both Road AB are possible but limited to half of the pedestrian crossing lines 106 and the pedestrians are forced to stop in the middle of the cross lines to avoid conflict with passing vehicles. Similarly, traffics on Road B, X, and Y are having the same traffic conflicts.

Therefore, as described in the preceding paragraphs, the traditional traffic allocation system is both unsafe and inefficient enough. Because pedestrians cross the road while vehicle traffics, including turn traffics, proceed, it is likely that pedestrian and vehicle traffic could enter the same space at the same time to cause collision. Both pedestrian and vehicles in the intersection are required to reduce their speed to observe other traffics to avoid accident. Lower speed in passing the intersection reduces the efficiency of the whole traffic system. In addition, U turn in the system is sometimes not allowed because it would significantly increase the risk of traffic accident.

The present system of "Red/Green/Yellow" signal combination is not a perfect traffic control method as it may result in many accidents, especially during the signal change interval from yellow and following all-red periods.

In the United States and most countries, the sequence of traffic signal is red, green, and yellow. Generally, at the end of green light time, vehicles are more likely to proceed as a free flow, which means vehicles are often moving at high speed. Inevitably, when the signal of yellow light is starting, vehicle drivers often have a special difficulty, particularly at intersections of arterial roads where speed limit may be as high as 50 mph. Drivers may experience uncertainty to make a proper decision: while to continue proceeding may result a red-light running, yet at the same time it is also difficult to stop properly because an abrupt stop may cause rear-end crashes. This special difficulty is known as "dilemma zone" problem.

The Institute of Transportation Engineers (ITE) handbook defines a "dilemma zone" as a range, in which a vehicle approaching the intersection during the interval of yellow light can neither safely clear the intersection, nor stop comfortably behind the stop-line. According to information provided by Federal Highway Administration (FHWA), research has found that more than 50% of red-light violations happen within the first 0.5-seconds of the red signal indication and 94.2% of red-light violations occur within the 2.0-seconds of the red-light onset. It can be convincingly reasoned that among in all violations of red light, deliberate violations of red light (after 2 seconds of red-light onset) only accounts a tiny percentage hence almost all red-light violations would be entirely avoided if the dilemma zone problem could be satisfactorily solved.

From the view of logic, both the signal of a green light and the signal of a red light could be easily defined and have been strictly defined: a green light is a signal of "Yes" and a red light is a signal of "No". In our daily life, the signal of a green light (or a red light) provides specific and clear instruction: a green light is a signal that means "traffic may proceed" and a red light is a signal that means "traffic may not proceed".

However, from the view of logic, a yellow light is neither a signal of "Yes" nor a signal of "No". Indeed a yellow light cannot be defined by one single word. At present, a yellow light can only provide general and fuzzy suggestions: a yellow light warns that the signal is about to change to red and according to the law, in the interval of yellow light, if the vehicles are in the intersection, drivers should continue moving and clear the junction safely but if they are not in the intersection, they can come to a safe stop. Therefore, when a yellow light starts, drivers must make their own decision of whether to stop or not based their own judgment. It can be convincingly concluded that a yellow light is not is a strict signal of specific instructions, rather, it is a signal of general suggestions or warnings.

In the United States, the law as stated in the Universal Vehicle Code (UVC) and Manual on Uniform Traffic Control Devices (MUTCD) is considered a Permissive yellow rule, that the driver can enter the intersection during the entire yellow interval and be in the intersection during the red indication as long as the driver entered the intersection during the yellow interval. In the United States, most states adopt Permissive yellow rule that violation only occurs if driver enters intersection after onset of red. Some states adopt Restrictive yellow rule that driver can neither enter nor be in intersection on red hence violation occurs if driver has not cleared intersection after onset of red.

The fundamental difference between Permissive yellow rule and Restrictive yellow rule could be summarized best as different priority of safety concern. While the Restrictive yellow rule emphasizes to reduce the possibility of red-light running, the Permissive yellow rule emphasizes to reduce the possibility of rear-end collisions. However, since the dilemma zone problem has two main safety issues of both red-light running and rear-end collisions, then neither Permissive yellow rule nor Restrictive yellow rule could satisfactorily solve the dilemma zone problem.

Research suggests that both the location and length of the dilemma zone is a dynamic range and may vary with the complex interactions between the response of drivers, the duration of yellow interval, traffic speeds, deceleration and acceleration rate, condition of pavement and intersection geometry, etc. Briefly, different drivers may experience different feeling of the location and length of the dilemma zone.

At present, there are two common practices aimed to mitigate the problem of dilemma zone. The first practice is to extend the length of yellow interval. The second practice is to extend the length of all red period. In real life, the mitigation effect of a prolonged yellow interval is very limited because a prolonged yellow interval often has been seemed as the extension of green light signal by many drivers. Similarly, possibility of speeding at the last second of yellow interval increases if drivers have learned that there is a prolonged all red period.

There are two main reasons why a prolonged yellow interval or all red period could not satisfactorily solve the problem of dilemma zone: (1), at present, when vehicle drivers feel they are in the location of dilemma zone, there is no assistance available to help them make a proper decision; (2), after the onset of yellow light, vehicles are still allowed to enter the dilemma zone. If an extended yellow light time cannot stop vehicles from entering the dilemma zone, then these new coming vehicles will still be involved the problem of dilemma zone, especially if these vehicles are still moving at high speed.

In some other countries, a green light flashes at the last several seconds of a green interval to provide warning of signal change in advance. In the United States, this treatment had been experimented by several states but the performance was not satisfying. Statistics suggest that drivers are more likely to speed up when a green light flashes hence the possibility of crashes is actually increasing. FHWA has made an official decision to stop further experiments on a flashing green light in the United States.

In real life, there are various road types with different positioning, different standards in design and different strategy in operation. An arterial road is a high-capacity urban road, which stands an intermediate position between freeways and collector/distributor roads in the hierarchy. In metro areas, arterial roads or major roads occupy a key position in the ground transportation system. If arterial & major roads are not effectively organized and efficiently operated, the performance of both freeway network and collector/distributor roads will be affected negatively and the whole ground transportation network may suffer speed and traffic capacity loss.

An arterial road is designed to deliver traffic at a level of service (LOS) as high as possible and the speed limits on an arterial road are typically between 50 and 80 km/h, much higher than those on collector/distributor roads. However, at present, at rush hours the LOS of an arterial road may often fall rapidly and the operating speed may be below 30 km/h or even below 20 km/h, which means an arterial road has failed to meet its positioning.

Arterial traffic is substantially different from ordinary collector/distributor roads. To increase traffic flow and speed, the numbers of intersections of arterial roads are often reduced and as a result, the average distance between two intersections on an arterial road is much longer compared to the average distance between two intersections on ordinary collector/distributor roads. It is desirable for an arterial road to be organized and operated like a freeway; not like an ordinary collector/distributor road. However, at present it is common that an arterial road is usually organized or signalized in the exact same way as an ordinary collector/distributor road.

At present, although a lane control light system may be adopted at some arterial roads, generally the performance is not satisfying. The present lane control light system consists of a downward green arrow, a red cross, and a yellow arrow. At present, a stop and queue signal such as a downward red arrow is not integrated as a part of the lane control light system.

A red cross is very different from a plain red light at signalized intersections or crosswalks. Normally, vehicles are required to stop and queue when a plain red light is on, which suggests to deny vehicles proceeding for a short period. By contrast, a red cross suggests to deny vehicles proceeding for a long time, such as hours, hence vehicles are required to use other lane(s) at the signal of a red cross. Vehicles are not suggested to, indeed required not to, queue at the signal of a red cross because normally there is no stop line at all.

The missing of a downward red arrow in a lane control light system is a serious deficiency. It means an extreme important function in traffic control, to stop vehicles of one or more lanes for a short period, is also missing accordingly. At present, a downward red arrow is missing because there is no stop line in the corresponding lane markings at all. A stop line is missing in the corresponding lane markings because drivers would be confused by a stop line if the lane control light is off: as a part of lane marking, a stop line is permanently on while a lane control light system may be on or off. The same problem also occurs at freeways, tunnels, and bridges.

FIG. 18 illustrates a traditional arterial road organization. As shown in FIG. 18, when the traffic on roads X and Y are stopped during a red light at an intersection, all the vehicles are stopped behind the stop line (SL). All vehicles have to queue behind the stop line until the traffic along the roads X and Y resumed. If a number of vehicles arrived at the intersection during the red light interval, vehicles often have difficulty making a lane change after the red light interval, although the green light signal is already on. This is because that it is difficult to find a space to make a lane change since there are continuous vehicles moving at the neighbor lanes. The lane change becomes increasingly difficult with increasing number of more lanes.

FIG. 19 illustrates the traffic weavings on a road with traditional road organization. As shown in FIG. 19, after the traffic along the roads X and Y is resumed, vehicles may change lanes, causing traffic weavings (W). Substantial traffic efficiency/capacity green light time may be lost. Traffic weavings may also significantly increase the risk of collisions. Thus, if an arterial road is organized and signalized as an ordinary collector/distributor road, the risk to road safety may be increased and the traffic capacity may be lost. The problem may be particularly pronounced during rush hour, when a large numbers of vehicles arrive at the intersection. The similar problem may also occur at a controlled/signalized crosswalk.

At signalized intersection, when a green light is on, it often takes substantial "response time" for vehicles to reach a relatively high speed, starting to accelerate from unmoving status. Normally, the first four or five vehicles take relatively long response time, and then the vehicles behind them may start to move as a relatively free flow.

In the traditional road organization system, pedestrians share the green light time with turning vehicles. FIGS. 20 to 22 illustrate traffic movements in three phases of traffic passing permit in a T section in a traditional road system. FIG. 20 illustrates the traffic movements in the first phase of the traditional system 2000, including pedestrian traffic 2002, vehicle through traffic 2004, vehicle right turn traffic 2006, bicycle through traffic 2008, and bicycle right turn traffic 2010. All the vehicle traffics on road Y, including the through traffic 2004, and turn traffic 2006, are permitted to proceed, while no vehicle is permitted to pass through the intersection from other roads. The pedestrian traffics 2002 on roads AB are possible but limited to half of the pedestrian crossing line 2012 and the pedestrians are forced to stop in the middle of the cross line to avoid conflict with passing vehicles and bicycle. Traffic accident is likely to occur if the pedestrian proceeds into the vehicle pathway 2006 and/or the bicycle pathway 2010. Thus, the pedestrian, the driver in the turning vehicle, and the turning cyclist would have to reduce their speed to observe other traffics to avoid accident. In some jurisdictions, vehicles and bicycles on Road B are allowed to turn right even under the red light, further increasing the risk of collision between vehicles and pedestrians.

FIG. 21 illustrates the traffic movements in the second phase of the traditional system 2000, including pedestrian traffic 2002, vehicle through traffic 2004, vehicle left turn traffic 2114, and bicycle through traffic 2008. All the vehicle traffics on road X, including the through traffic 2004, and turn traffic 2114, are permitted to proceed, while no vehicle is permitted to pass through the intersection from other roads. The pedestrian traffics 2002 on roads AB are possible but limited to half of the pedestrian crossing line 2012 and the pedestrians are forced to stop in the middle of the cross line to avoid conflict with passing vehicles and bicycle. Traffic accident is likely to occur if the pedestrian proceeds into the vehicle pathway 2114. Thus, the pedestrian and the driver in the turning vehicle would have to reduce their speed to observe other traffics to avoid accident. The cyclist on road X is not allowed to make a left turn as such a turn would interfere with the traffic 2004. In some jurisdictions, vehicles and bicycles on Road B are allowed to turn right even under the red light, further increasing the risk of collision between vehicles and pedestrians.

FIG. 22 illustrates traffic movements in the third phase of the traditional system 2000, including pedestrian traffic 2216, vehicle right turn traffic 2218, vehicle left turn traffic 2220, bicycle through traffic 2008, and bicycle right turn traffic 2222. All the vehicle traffics on road B, including the right turn traffic 2218, and left turn traffic 2220, are permitted to proceed, while no vehicle is permitted to pass through the intersection from other roads. The pedestrian traffics 2216 on roads XY are possible but limited to half of the pedestrian crossing line 2224 and the pedestrians are forced to stop in the middle of the cross line to avoid conflict with passing vehicles and bicycle. Traffic accident is likely to occur if the pedestrian proceeds into the vehicle pathway 2218 or bicycle pathway 2222. Thus, the pedestrian, the driver in the turning vehicle and the turning cyclist would have to reduce their speed to observe other traffics to avoid accident. In some jurisdictions, vehicles and bicycles on road Y are allowed to turn right even under the red light, further increasing the risk of collision between vehicles and pedestrians.

The disclosed systems and methods are directed at solving one or more problems set forth above and other problems.

BRIEF SUMMARY OF THE DISCLOSURE

One aspect of the present disclosure provides a traffic resource allocation method for allocating traffic resources around an intersection formed by a first road and a second road. The method includes dividing the first road into two or more first lanes at a first direction and two or more second lanes at a second direction opposite but parallel to the first direction. The method also includes dividing the second road into two or more third lanes at a third direction and two or more fourth lanes at a fourth direction opposite but parallel to the third direction. Further, the method includes controlling traffic movements in the intersection by allocating traffic passing permit to both pedestrian traffic and vehicle traffic on the first road and second road. The method also includes, when permitting pedestrian traffic along the first direction and the second direction, permitting through vehicle traffic along the first direction and the second direction, and prohibiting turn traffic at any of the first, second, third, and fourth directions.

Another aspect of the present disclosure provides a traffic system for allocating traffic resources around an intersection formed by a first road and a second road. The first road is divided into two or more first lanes at a first direction and two or more second lanes at a second direction opposite but parallel to the first direction, and the second road is divided into two or more third lanes at a third direction and two or more fourth lanes at a fourth direction opposite but parallel to the third direction. The traffic system includes a set of traffic lights and a controller. The controller controls the set of traffic lights and is configured to control traffic movements in the intersection by allocating traffic passing permit to both the pedestrian traffic and vehicle traffic. When the controller is configured to permit pedestrian traffic along the first and the second direction, the controller is configured to permit through vehicle traffic along the first direction and the second direction, and to prohibit turn traffic at any of the first, second, third, and fourth directions.

Another aspect of the present disclosure provides a traffic lane control method for controlling lane traffic. The method includes dividing a road into one or more lanes. The method also includes providing a control line with a lane control light system. Further, the method includes providing a control area with a pre-determined length after the control line in the direction of the traffic. The method also includes controlling traffic movement on the road by permitting a vehicle on one or more lanes to pass the control line, and controlling a traffic movement on the road by prohibiting a vehicle on other lane to pass the control line.

Another aspect of the present disclosure provides a method for controlling traffic around an intersection. The method includes a cushion zone with a first pre-determined length, a control zone with a second pre-determined length, and a rear zone. The cushion zone is closest to a stop line with a traffic light system and the rear zone is farthest to the stop line. A traffic on the road travels in the direction from the rear zone to the stop line. The method also includes instructing vehicles in the cushion zone, the control zone, and the rear zone during a traffic light cycle.

Another aspect of the present disclosure provides a method for allocating traffic resources around a T shaped intersection formed by a first road and a second road. The method includes dividing the first road into two or more first lanes at a first direction and two or more second lanes at a second direction opposite but parallel to the first direction. The method also includes dividing the second road into two or more third lanes at a third direction and two or more fourth lanes at a fourth direction opposite but parallel to the third direction. Further, the method includes controlling traffic movements in the intersection by allocating traffic passing permit to pedestrian and vehicle traffic on the first road and second road. The method also includes, when permitting pedestrian traffic along the first direction and the second direction, permitting through vehicle traffic along the first direction and the second direction, and prohibiting turn traffic at any of the first, second, and third directions.

Other aspects of the present disclosure can be understood by those skilled in the art in light of the description, the claims, and the drawings of the present disclosure.

BRIEF DESCRIPTION OF THE DRAWINGS

FIG. 29 illustrates an exemplary three-phase traffic passing permit allocation system in a "T" intersection;

DETAILED DESCRIPTION

Reference will now be made in detail to exemplary embodiments of the invention, which are illustrated in the accompanying drawings. Wherever possible, the same reference numbers will be used throughout the drawings to refer to the same or like parts.

Figure 1:
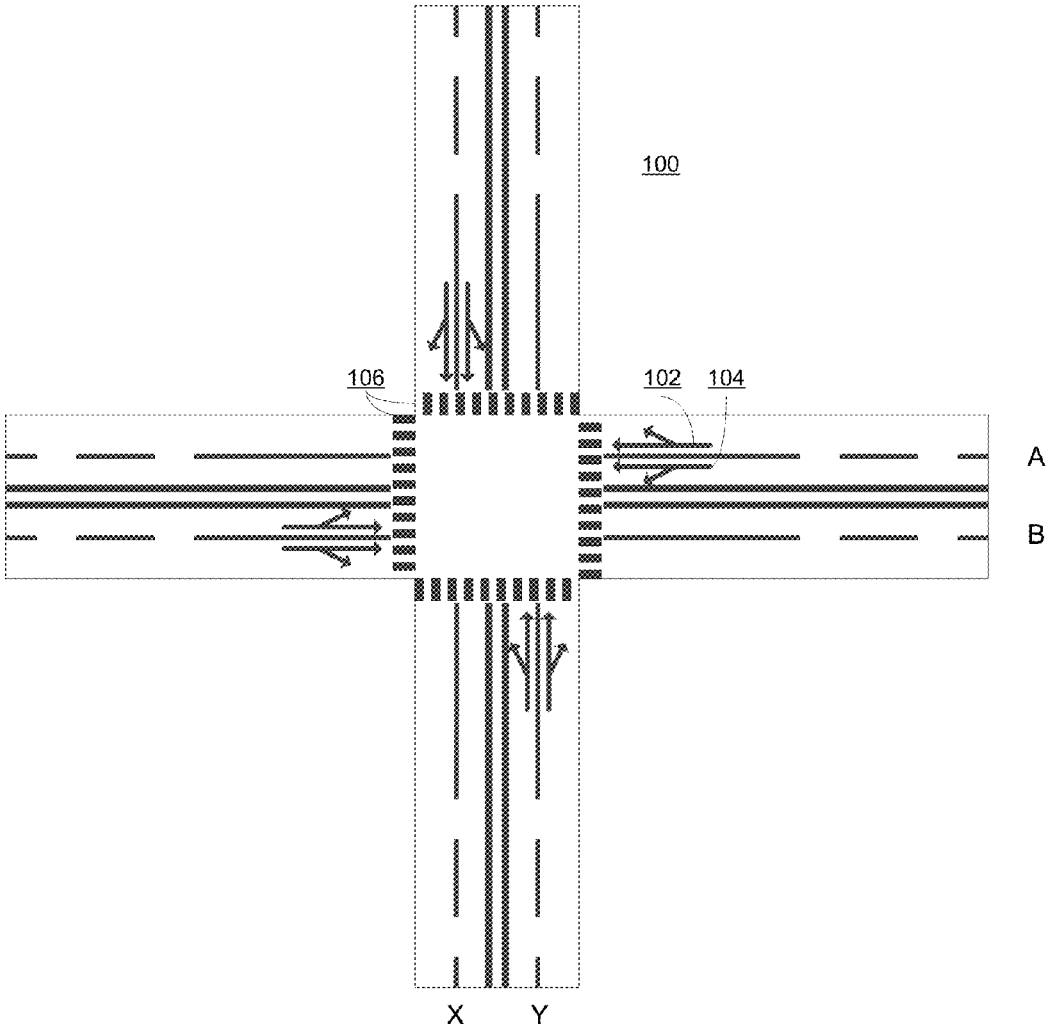
Fig. 1 (Prior Art)
FIG. 1 illustrates an overview of a traditional traffic system.
Figure 2:
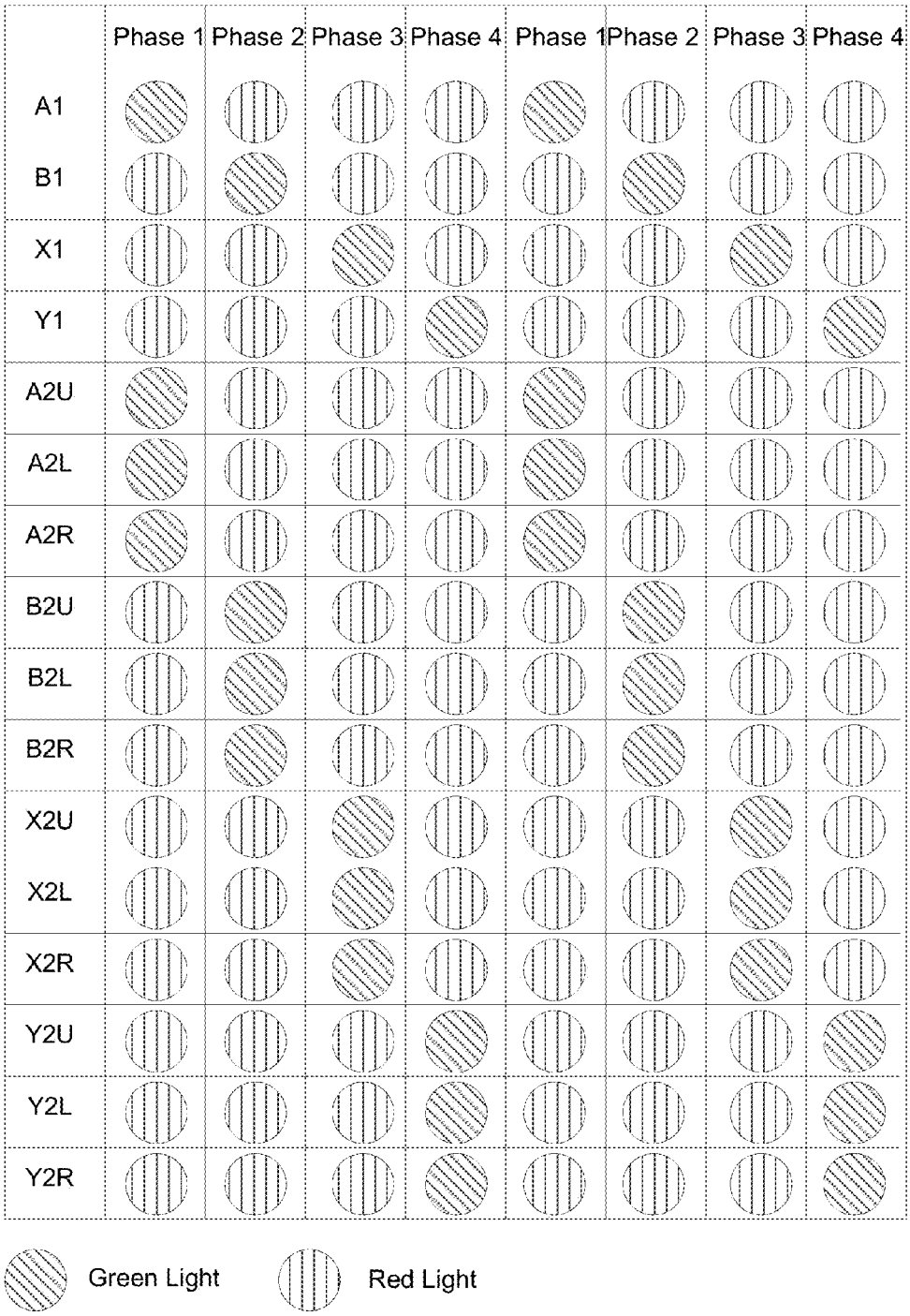
Fig. 2 (Prior Art)
FIG. 2 illustrates traffic signal phases in traditional traffic system.
Figure 3:
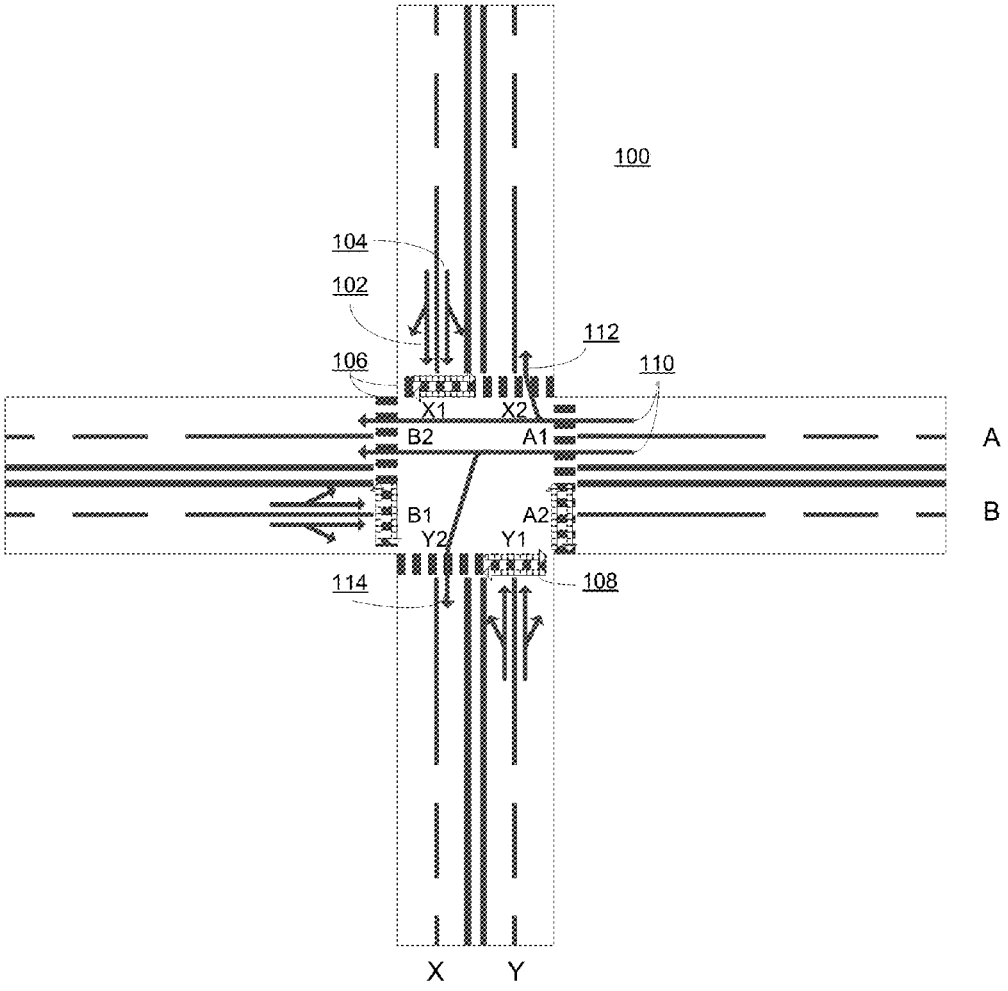
Fig. 3 (Prior Art)
FIG. 3 illustrates the traffic movement of the first phase in a traditional traffic system.
Figure 4:
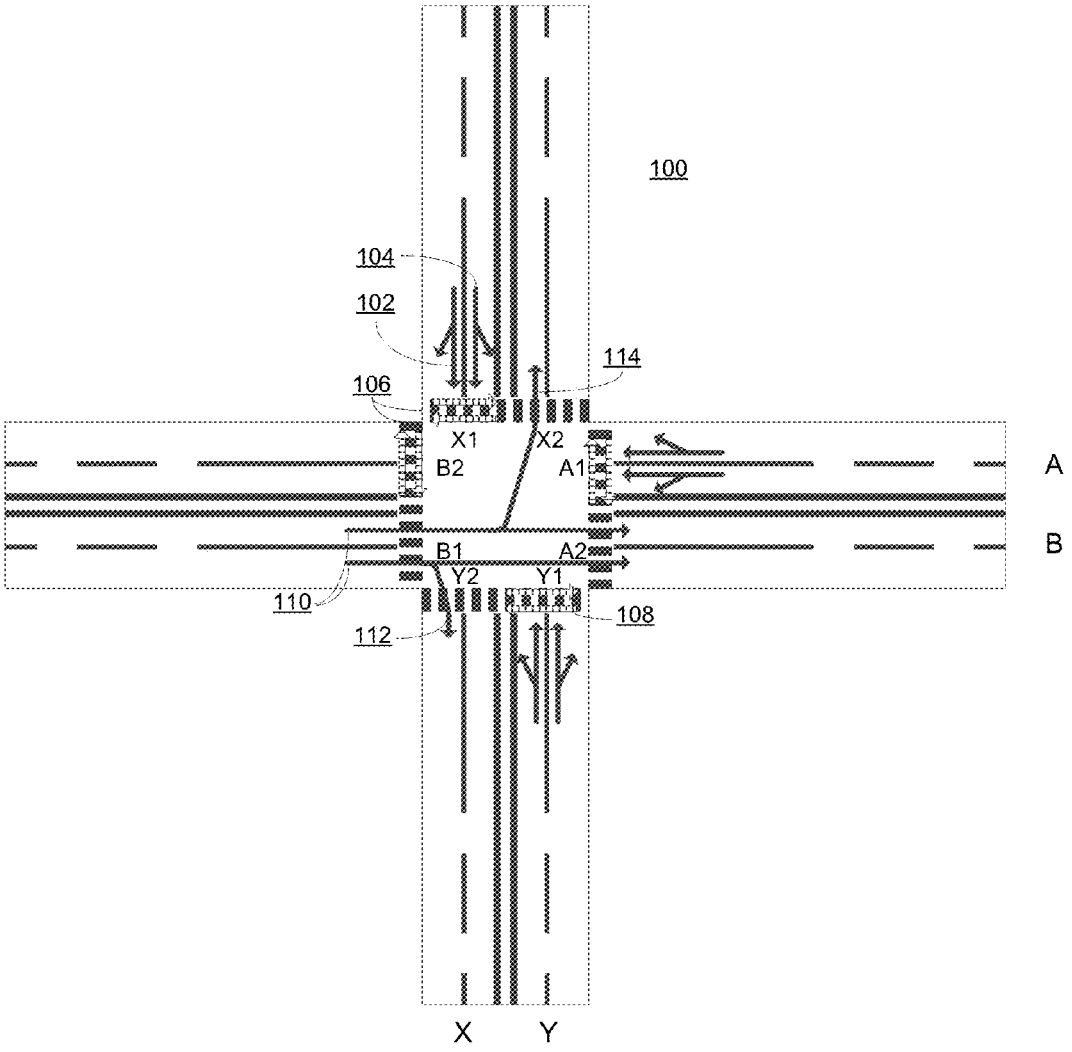
Fig. 4 (Prior Art)
FIG. 4 illustrates the traffic movement of the second phase in a traditional traffic system.
Figure 5:
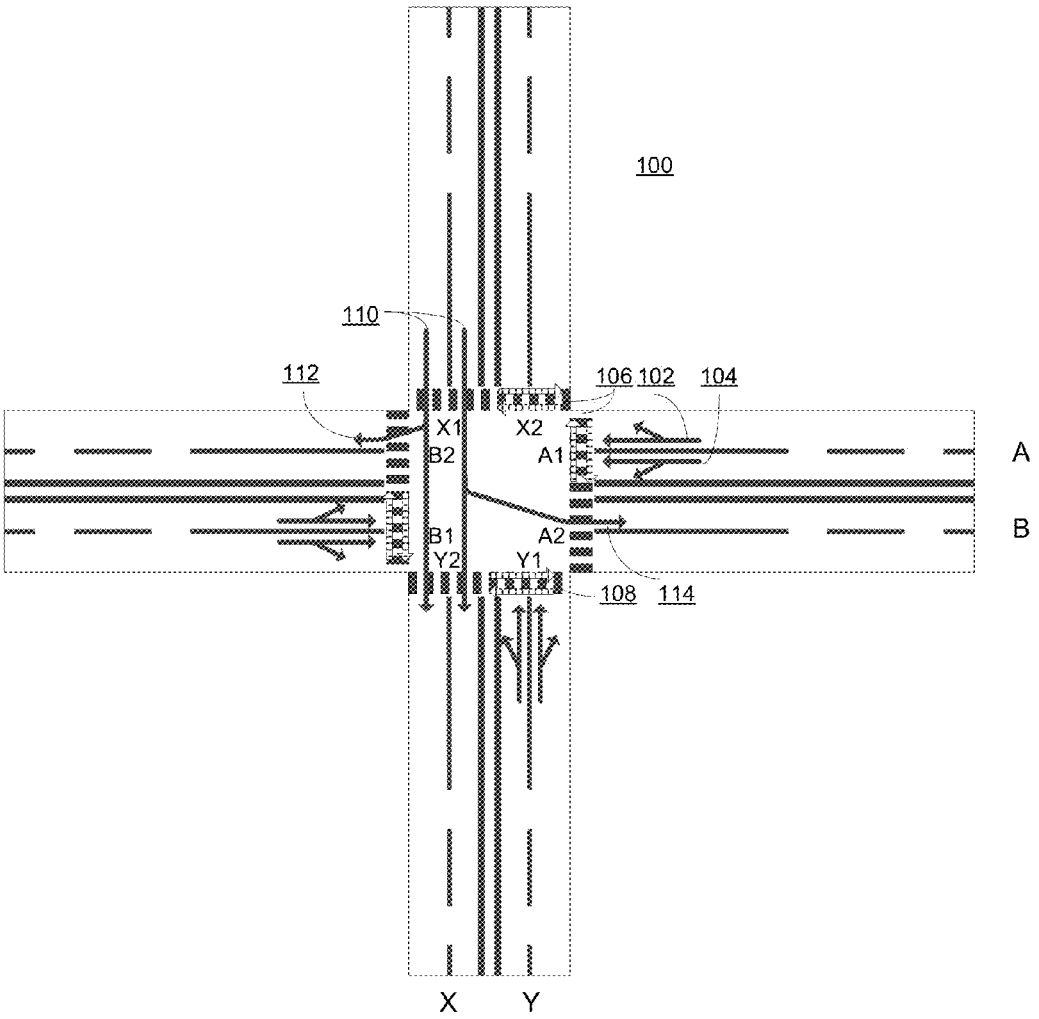
Fig. 5 (Prior Art)
FIG. 5 illustrates the traffic movement of the third phase in a traditional traffic system.
Figure 6:
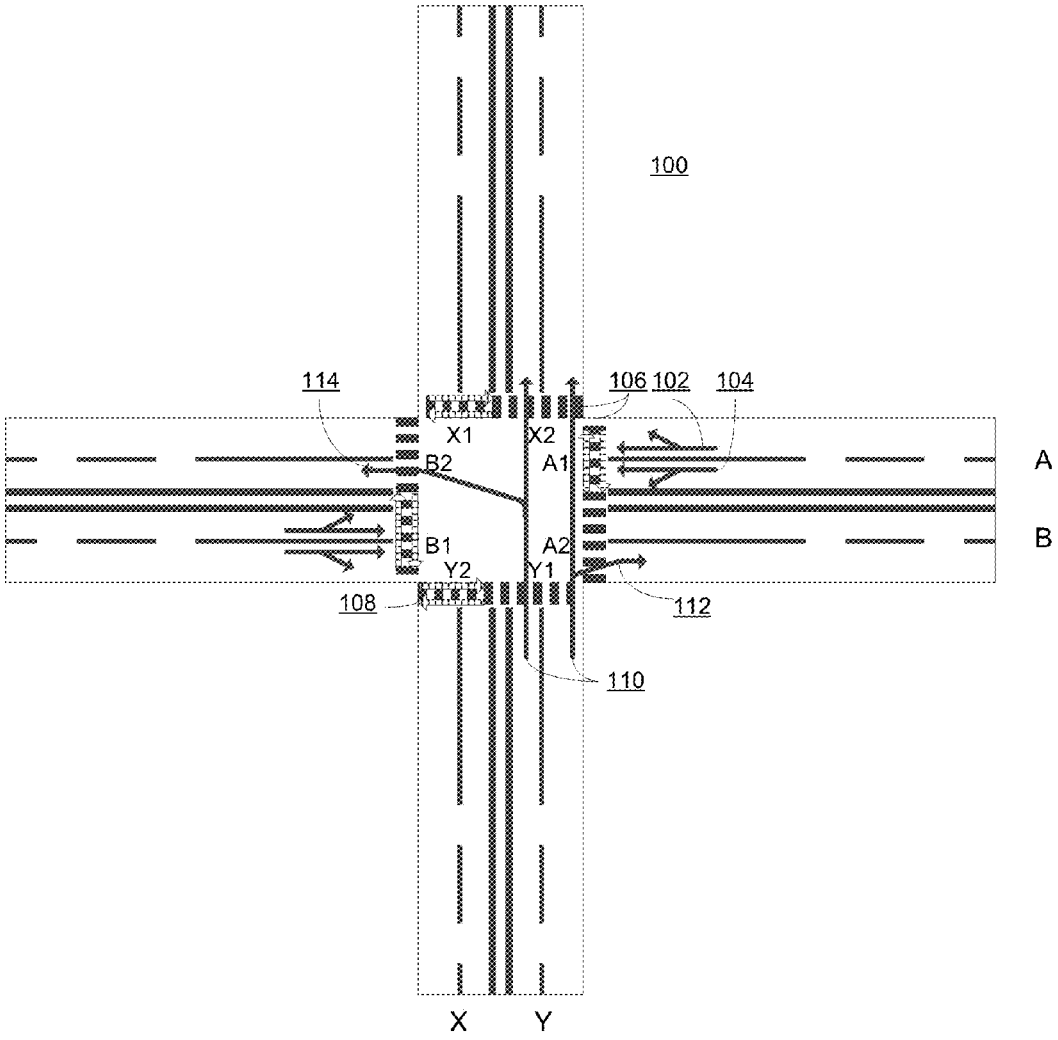
Fig. 6 (Prior Art)
FIG. 6 illustrates the traffic movement of the fourth phase in a traditional traffic system.
Figure 7:
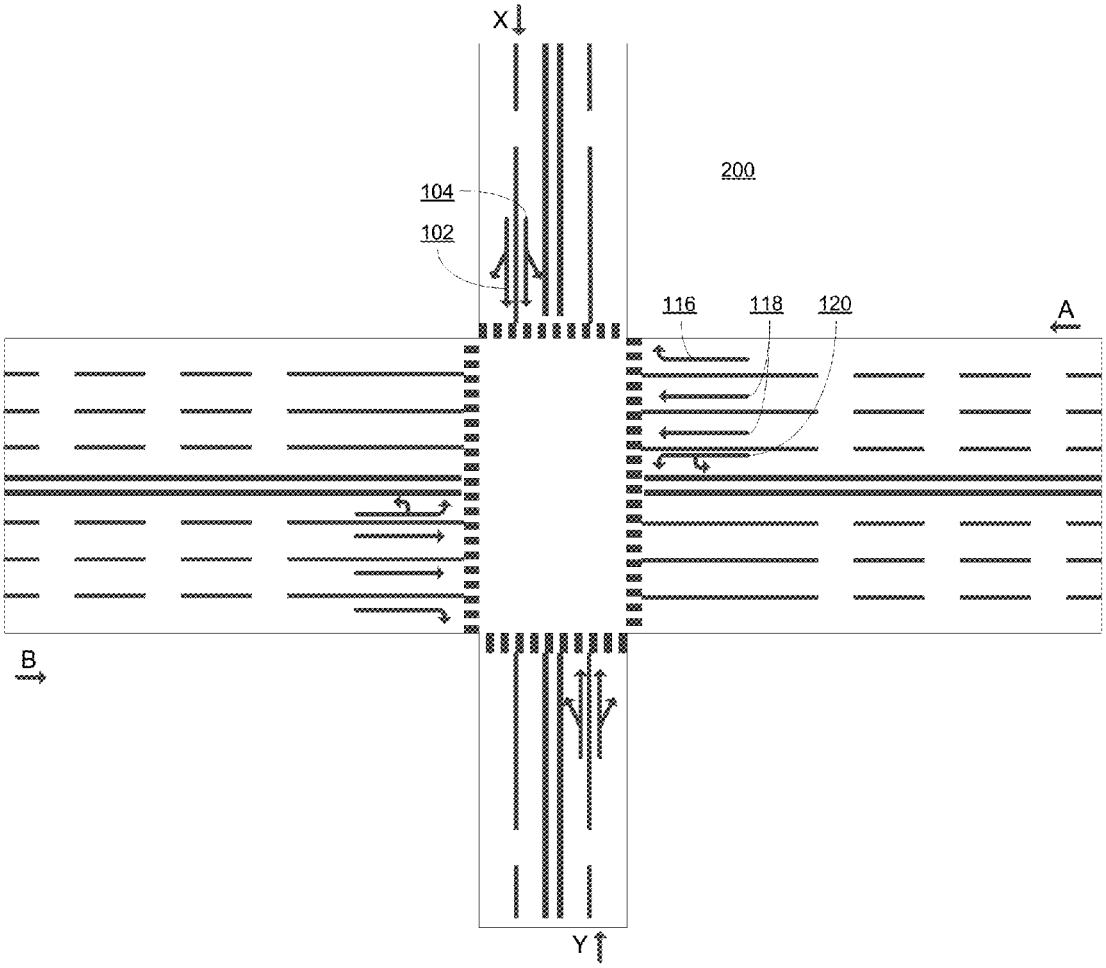
Fig. 7 (Prior Art)
FIG. 7 illustrates an overview of another traditional traffic system.
Figure 8:
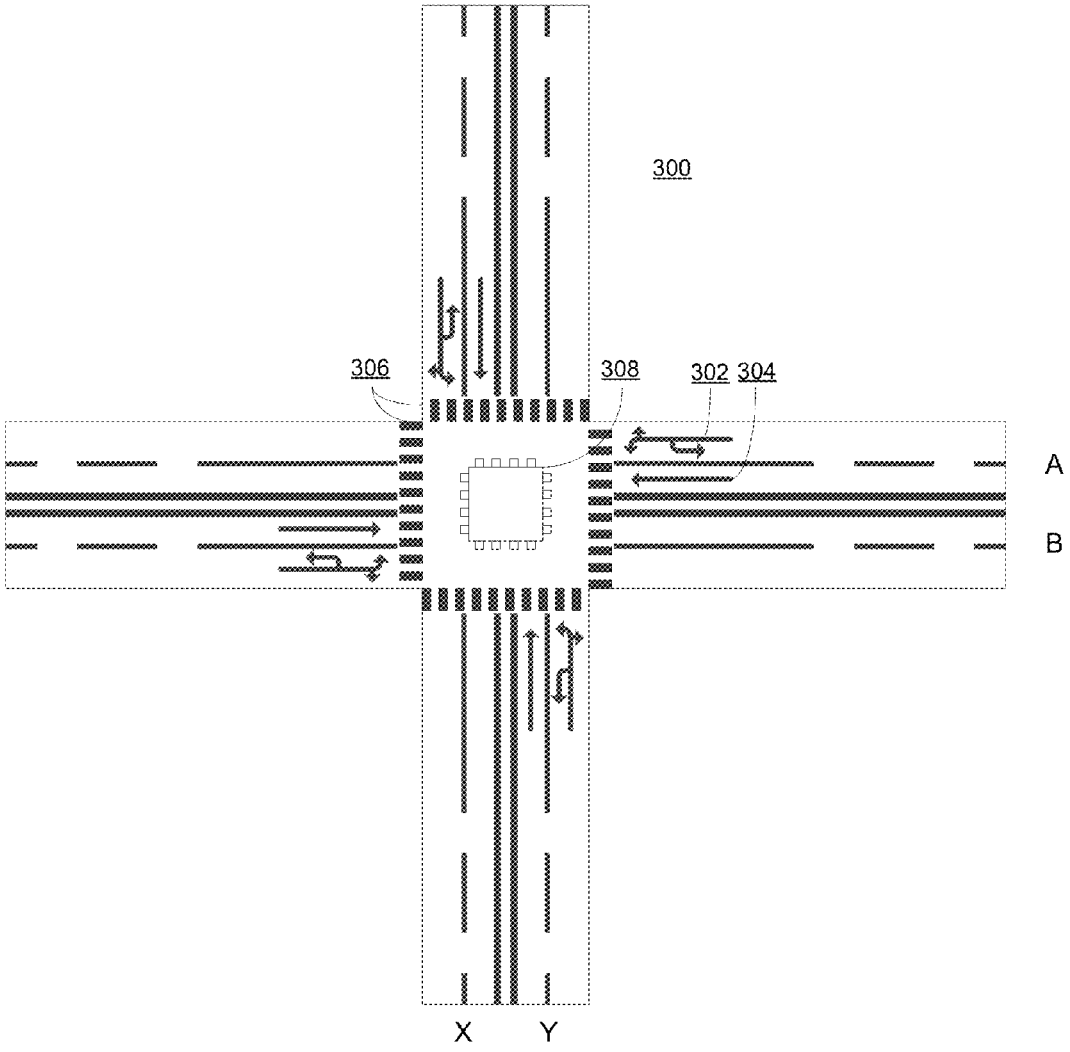
FIG. 8 illustrates an overview of an exemplary enhanced traffic system consistent with the disclosed embodiments.

The present disclosure provides a traffic system for allocating traffic resources and directing safe and efficient traffic movement in an intersection. FIG. 8 illustrates an exemplary traffic system 300 consistent with the disclosed embodiments.

As shown in FIG. 8, traffic system 300 is provided in an intersection where the Roads AB and XY intersect. The traffic system 300 includes a traffic light system 308, which includes four sets of traffic lights facing the Roads A, B, X, and Y. The traffic system 300 also includes a traffic space allocation system, which may include turn traffic marking 302 and through traffic marking 304 on Roads A, B, X, and Y, and markings on pedestrian cross line 306. The through traffic markings 304 are located on the innermost lane, while the turn marking 302, which combines right, left, and U turn markings, is located on the outer lane of the two-lane road (e.g., a curb lane).

That is, for intersection traffic, there may be four different traffic needs: through, U turn, left turn, and right turn. However, under the traffic system 300, there may be only two types of traffic: through traffic and turn traffic. The turn traffic may include any types of turn movements: U turn, left turn, and right turn. Further, lanes are divided into two different types of lanes using traffic markings and/or traffic lights: a through lane(s) and a turn lane(s). For example, an innermost lane (left lane) may be designated for through traffic only; and an outer lane (right lane) may be designated for turn traffic only.

The markings may be configured to provide instructions to the driver. For example, the markings may be placed on the surface of the road, or the markings may be placed on a roadside board instead of the surface of the road. The traffic system 300 may also use both roadside board markings and road surface markings. The number of the markings may be increased or reduced depending on the circumstances of the roads and the intersections. Further, the markings may have different shapes and types such that different types of markings may be used to indicate the allocation of the lanes according to the local standards.

Figure 9:
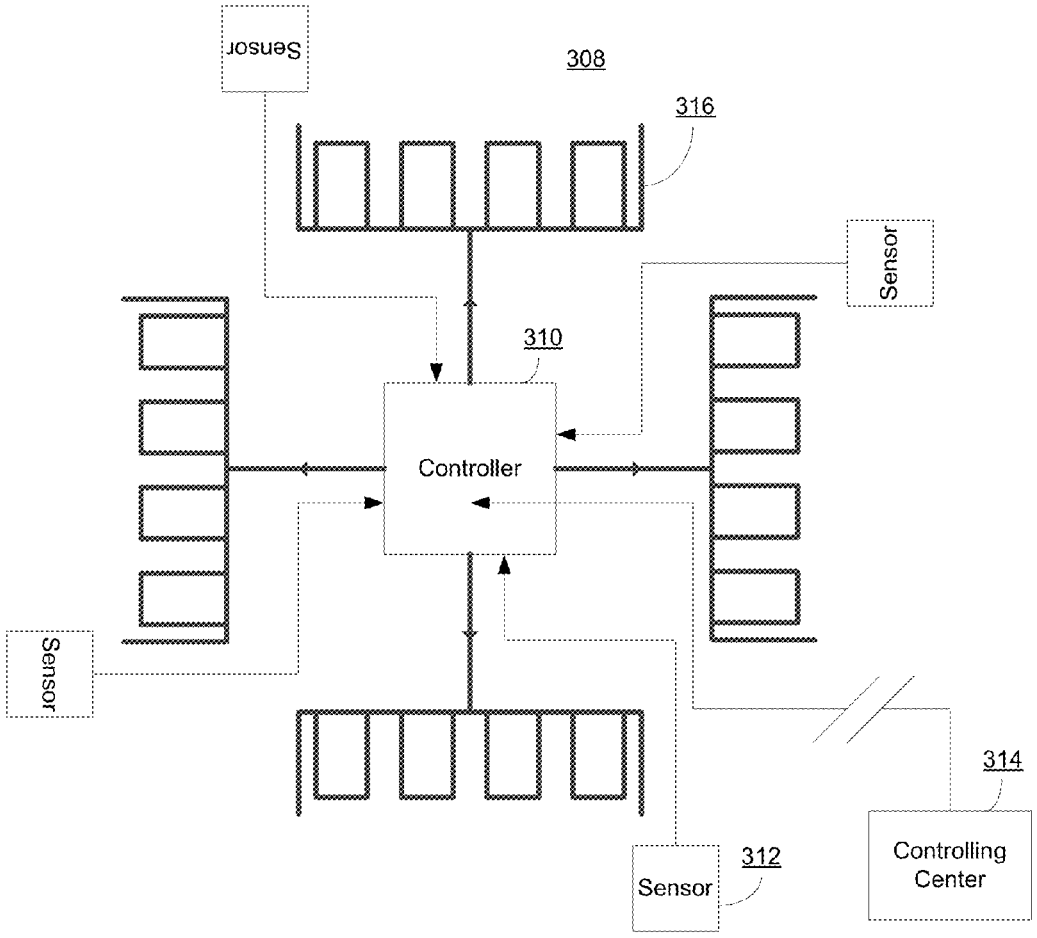
FIG. 9 illustrates an exemplary traffic light system consistent with the disclosed embodiments.

The traffic system 300 also includes a passing permit allocation system, such as a traffic light system. FIG. 9 illustrates an exemplary traffic light system 308 consistent with the disclosed embodiments. As shown in FIG. 9, the traffic light system 308 may include a controller 310, a plurality of traffic lights 316, a plurality of sensors 312, and a controlling center 314. Other components may also be included.

Controller 310 may perform certain control functions of the traffic system 300. Controller 310 may control traffic lights 316 automatically, or may control traffic lights 316 based on information received from sensors 312. Controller 310 may include a processor, such as any appropriate type of graphic processing unit (GPU), general purpose microprocessor, digital signal processor (DSP) or micro controller, or application specific integrated circuit (ASIC). The controller 310 may also include a memory module, storage media, and input/output devices to complete control functions. Further, controller 310 or the processor of the controller 310 may execute sequences of computer program instructions to perform various processes associated with traffic light system 308 and/or traffic system 300.

Further, controller 310 may also control traffic lights 316 based on information or instructions received from traffic controlling center 314. Traffic controlling center 314 may include any appropriate computer system or server for controlling traffic system 300 including performing certain algorithms to allocate traffic resources and controlling controller 310. Users at the controlling center 314 may also control the traffic system 300. In addition, other programs may also be implemented in the controlling center 314 to analyze information from the controller 310 and to present the results to the user(s). Controlling center 314 may be connected to the controller 310 via any appropriate communication channels, such as wired or wireless communication links.

Figure 10:
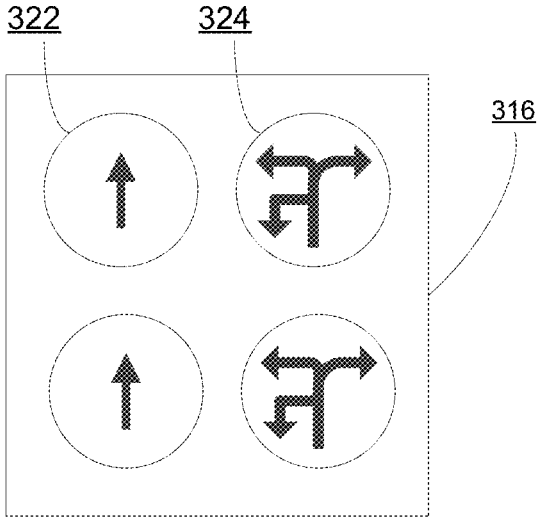
FIG. 10 illustrates an exemplary traffic light set consistent with the disclosed embodiments.

FIG. 10 illustrates an exemplary traffic light set 316. As shown in FIG. 10, a traffic light set 316 may include a through traffic light 322 marked with a straight arrow, and a turn traffic light 324 marked with right, left, and U turn arrows. The through traffic light 322 may include a single light having both red and green colors or two lights of red and green colors respectively, and the turn traffic light 324 may also include a single light having both red and green colors or two lights of red and green colors respectively. Other lights such as pedestrian lights (not shown) may also be included.

The traffic light system 308 may be configured in a variety of ways. The traffic light set 316 may be placed in any position that can provide clear signals to pedestrian and/or vehicle drivers, such as the center of the intersection or the corners of the intersection, etc. The traffic light set 316 may also be configured in certain ways. For example, the through traffic signal and the turn traffic signal may be merged on one light and the traffic movement may be controlled by the particular arrow signal that is turned on. The lights may be arranged horizontally or vertically. The traffic light system 308 may be an automatic system, or a manual system, or an automatic system that can be overridden manually. Further, an independent pedestrian signal light in addition to traffic light set 316 may be used to control the pedestrian traffic. The traffic light system 308 may be used independently or in combination with the road markings consistent with the disclosed embodiment.

Figure 11:
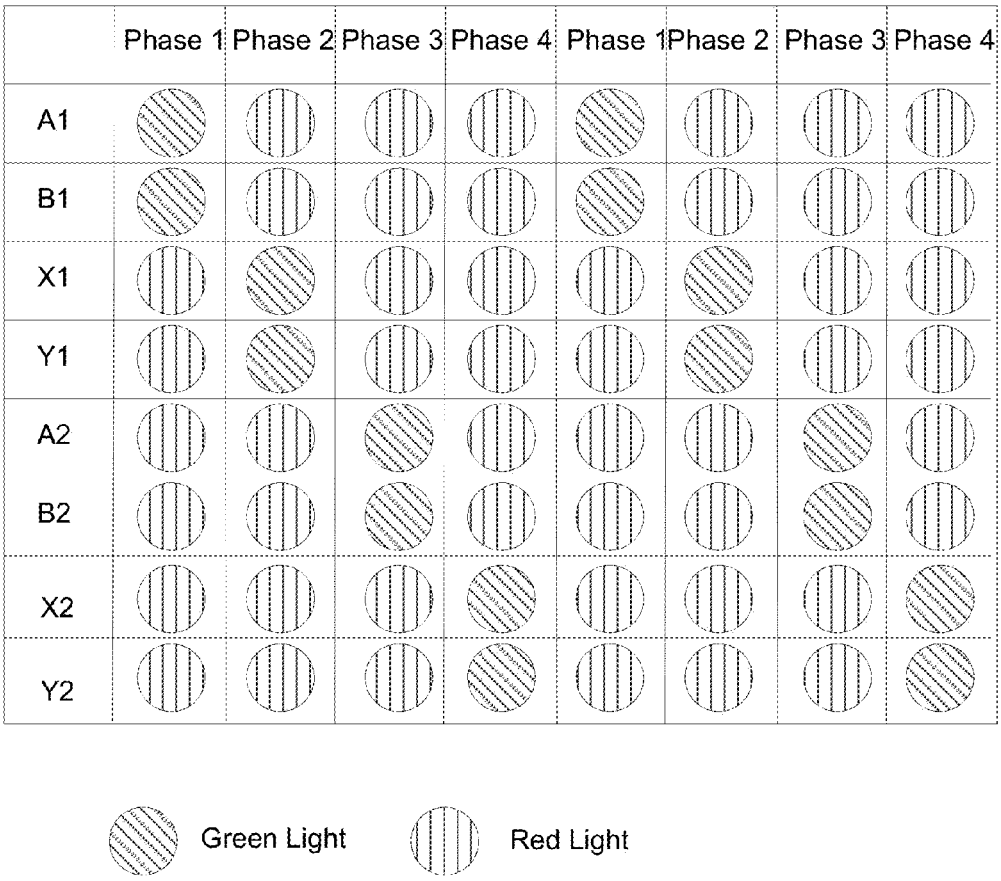
FIG. 11 illustrates exemplary traffic signal phases consistent with the disclosed embodiments.

The traffic light system 308 may be controlled by controller 310 or controlling center 314 to implement a four-phase traffic passing permit allocation. FIG. 11 illustrates an exemplary four-phase traffic passing permit allocation system in an intersection. The four phases of traffic passing permit allocation is also called a traffic allocation cycle.

According to the traffic system 300, all traffic participants may be classified into two basic types, pedestrians and non-pedestrians (e.g., vehicle traffic). Traffic system 300 may control both the pedestrian and non-pedestrian types of traffic such that, when there is a pedestrian traffic permitted, certain vehicle traffic may be prohibited; and when there is a vehicle traffic permitted, certain pedestrian traffic may be prohibited. Controller 310 may control the pedestrian traffic and non-pedestrian traffic by allocating two different types of passing permit: pedestrians permit and vehicle permit.

As shown in FIG. 11, the traffic passing permit allocation system uses four phases to control traffic movements in the intersection. Different number of phases may also be used in a single traffic allocation cycle. Further, only two colors (e.g., red and green) of traffic lights may be used, without the use of a yellow light. The two colors may represent only two types of signals: signals of Yes (green light) and signals of No (red light). That is, the signal of green light means Yes (permitted to proceed) and the signal of red light means No (stop). Other types of signals, such as the signals of yellow light, are not used.

The first phase is allocated to the vehicle through traffic and pedestrian traffic on Road AB. The through traffic lights on Road A and Road B (A1, B1) are green and other vehicle traffic lights are red. The second phase is allocated to the vehicle through traffic and pedestrian traffic on Road XY. The through traffic lights on Road X and Road Y (X1, Y1) are green and other vehicle traffic lights are red. The third phase is allocated to the vehicle turn traffic on Road A and Road B. The turn traffic lights on Road A and Road B (A2, B2) are green and other vehicle traffic lights are red, and the turn traffic lights A2 and B2 are used to signal a single turn traffic along Road A and Road B including A2U, A2L, A2R, B2U, B2L, and B2R. The fourth phase is allocated to the vehicle turn traffic on Road X and Road Y. The turn traffic lights on Road X and Road Y are green (X2, Y2) and other vehicle traffic lights are red, and the turn traffic lights X2 and Y2 are used to signal a single turn traffic on Road X and Road Y including X2U, X2L, X2R, Y2U, Y2L, and Y2R. The details of each traffic allocation phase are described below.

Figure 12:
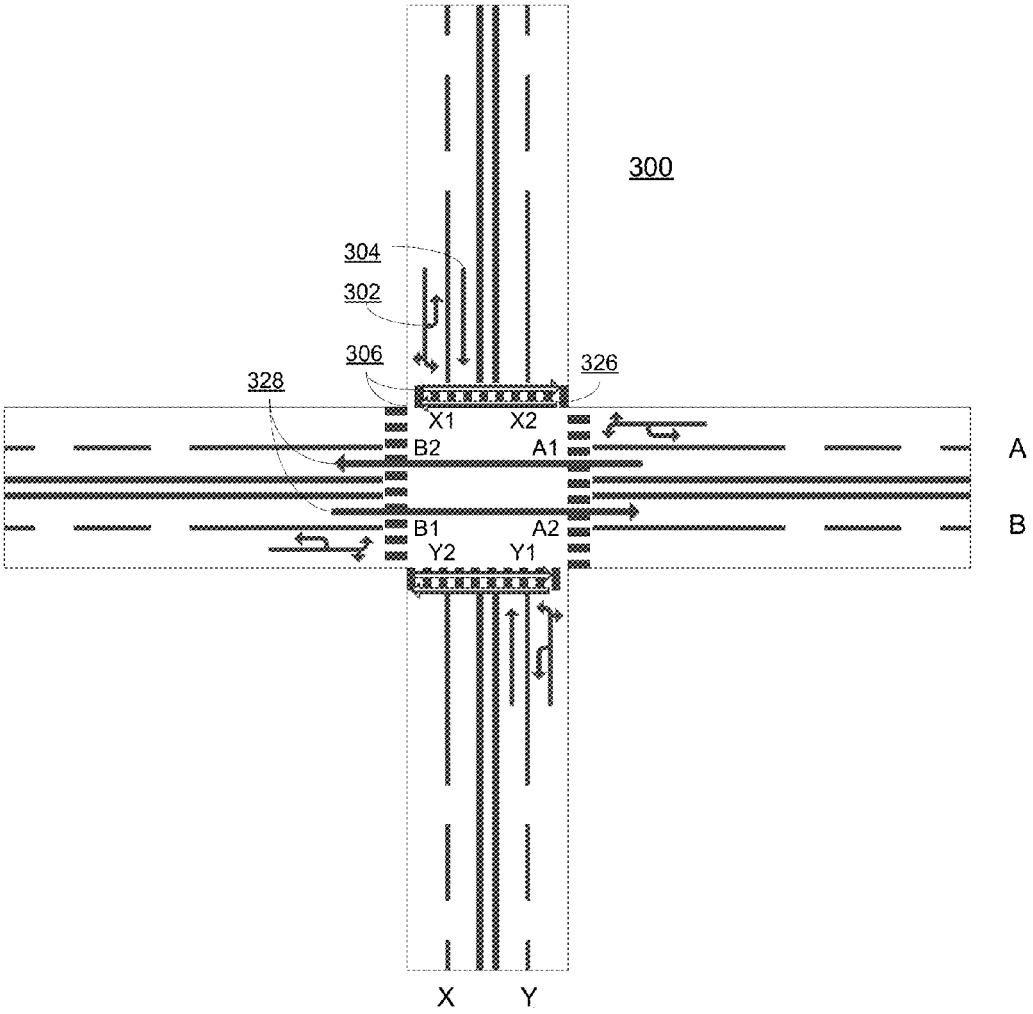
FIG. 12 illustrates exemplary traffic movements during the first phase consistent with the disclosed embodiments.

FIG. 12 illustrates traffic movements during the first phase. As shown in FIG. 12, A1, A2, B1, B2, X1, X2, Y1, and Y2 are the traffic lights in the traffic system 300. During the first phase, the vehicle through traffic 328 (A1, B1) and the pedestrian traffic 326 on both directions of Road AB proceed without interference from other traffic. Other vehicle traffics, such as turn traffic on both Roads AB and XY and through traffic in non-parallel directions, are not permitted. The pedestrian traffic 326 is permissible along the whole length of the pedestrian cross lines 306 on Road AB from both directions.

Figure 13:
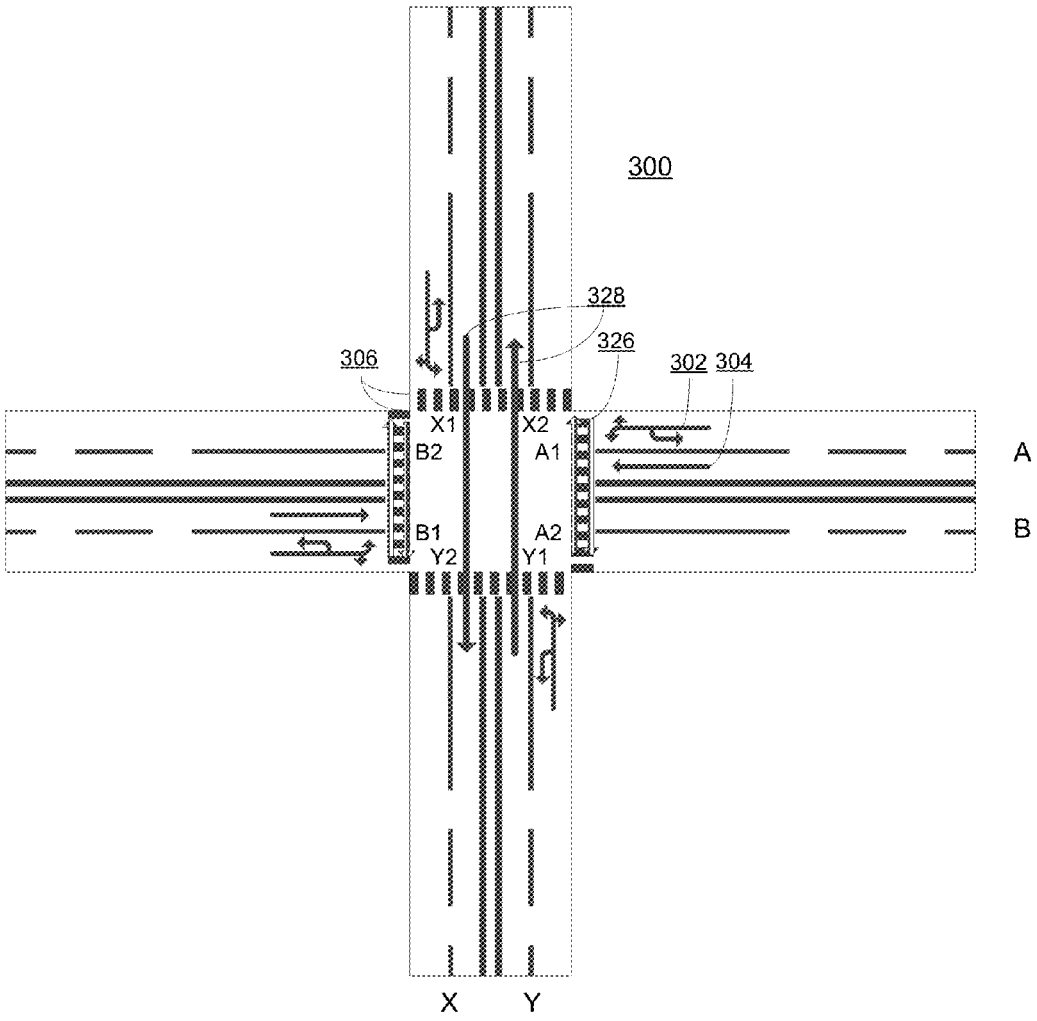
FIG. 13 illustrates exemplary traffic movements during the second phase consistent with the disclosed embodiments.

FIG. 13 illustrates traffic movements during the second phase. As shown in FIG. 13, during the second phase, the vehicle through traffic 328 (X1, Y1) and the pedestrian traffic 326 on both directions of Road XY proceed without interference from other traffic. Other vehicle traffics, such as turn traffic on both Roads AB and XY and through traffic in non-parallel directions, are not permitted. The pedestrian traffic 326 is permissible along the whole length of the pedestrian cross lines 306 on Road XY from both directions.

Figure 14:
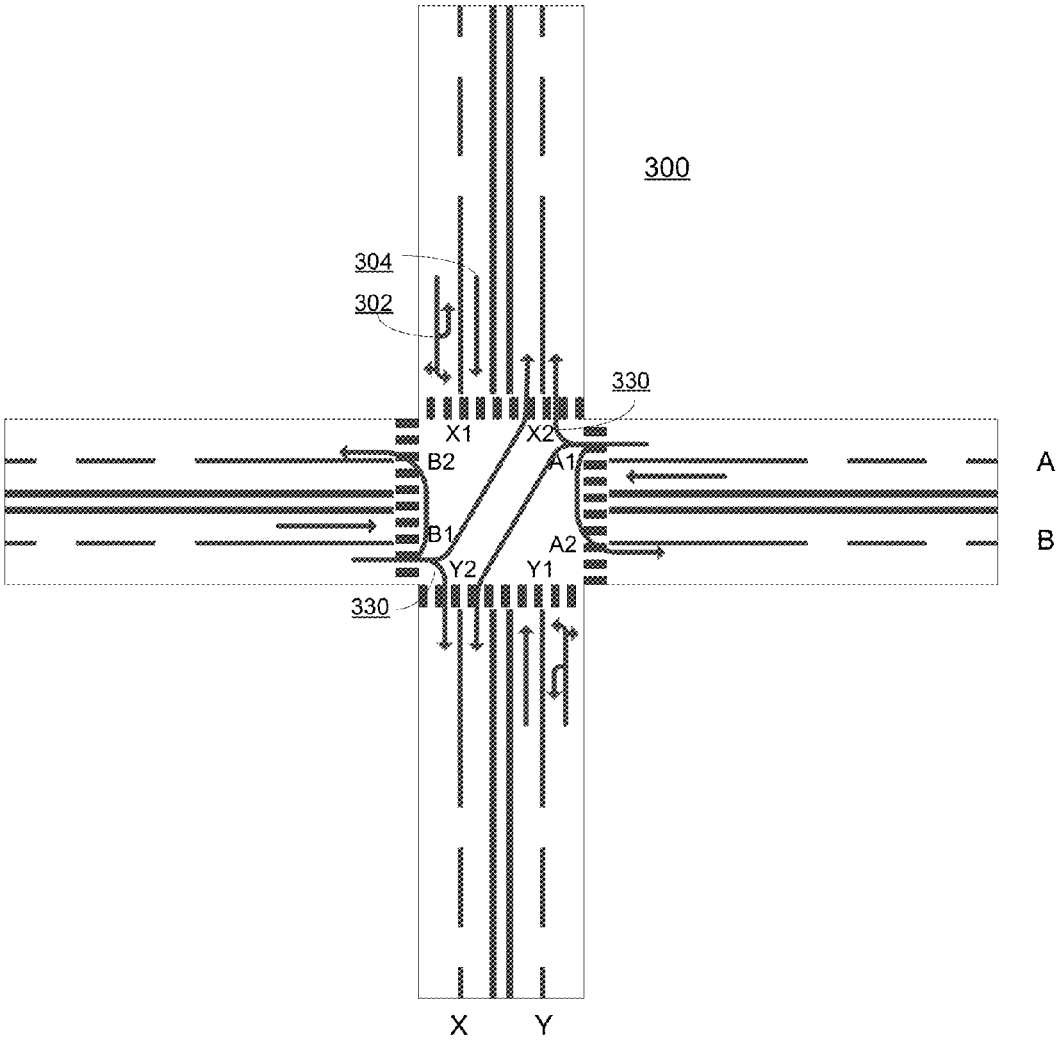
FIG. 14 illustrates exemplary traffic movements during the third phase consistent with the disclosed embodiments.

FIG. 14 illustrates traffic movements during the third phase of traffic allocation according to the disclosed embodiments. As shown in FIG. 14, during the third phase, the vehicle turn traffics 330 (A2, B2 or A2U, A2L, A2R, B2U, B2L, B2R) on both directions of Road A and Road B are permitted. Other traffics, such as through traffic on both Roads AB and XY and turn traffic on Road X and Y, are not permitted. Because, as previously described, the lanes are divided into a through lane and a turn lane, the turn traffic on Road A and Road B can proceed without interference from each other. For example, the left turn traffic from Road A and Road B onto Road X and Road Y can take the through lanes and the right turn traffic from Road A and Road B onto Road X and Road Y can take the turn lanes to avoid conflict. Also, U turn traffic in a two-lane setting can be permitted without any conflict. During this phase, pedestrian traffic is not permitted.

Figure 15:
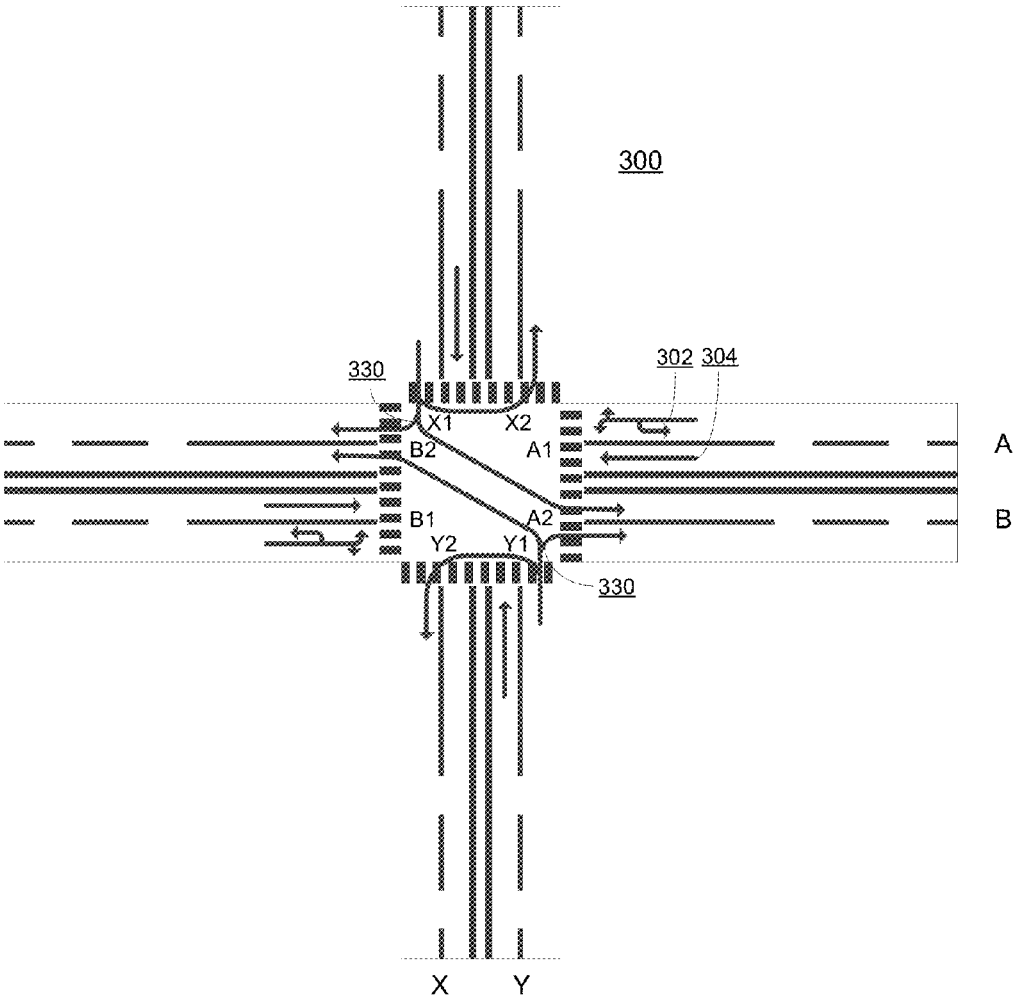
FIG. 15 illustrates exemplary traffic movements during the fourth phase consistent with the disclosed embodiments.

FIG. 15 illustrates traffic movements during the fourth phase of traffic allocation according to the disclosed embodiments. As shown in FIG. 15, during the fourth phase, the vehicle turn traffics 330 (X2, Y2 or X2U, X2L, X2R, Y2U, Y2L, Y2R) on Road X and Road Y are permitted. Other traffics, such as through traffic on both Roads AB and XY and turn traffic on Road A and B, are not permitted. Because the lanes are divided into a through lane and a turn lane, the turn traffic on Road X and Road Y can proceed without interference from each other. For example, the left turn traffic on Road X and Road Y onto Road A and Road B can take the through lanes and the right turn traffic on Road X and Road Y Road A and Road B can take the turn lanes to avoid conflict. U turn traffic can also be permitted without any conflict. During this phase, pedestrian traffic is not permitted.

With respect to the pedestrian traffic, during the four phases of the traffic allocation, the passing permit of the pedestrian traffic is in parallel with the passing permit of the through traffic such that the security and efficiency of the pedestrian traffic can be ensured. More specifically, when there is a permit of pedestrian traffic, vehicle traffic of parallel direction is also permitted; any other vehicle traffic (any turn traffic and through traffic not parallel to the pedestrian traffic) is not permitted. Similarly, when there is a permit of turn vehicle traffic, pedestrian traffic is not permitted; when there is a permit of through vehicle traffic, pedestrian traffic in the parallel direction is permitted and the pedestrian traffic not in parallel direction is not permitted.

Figure 16:
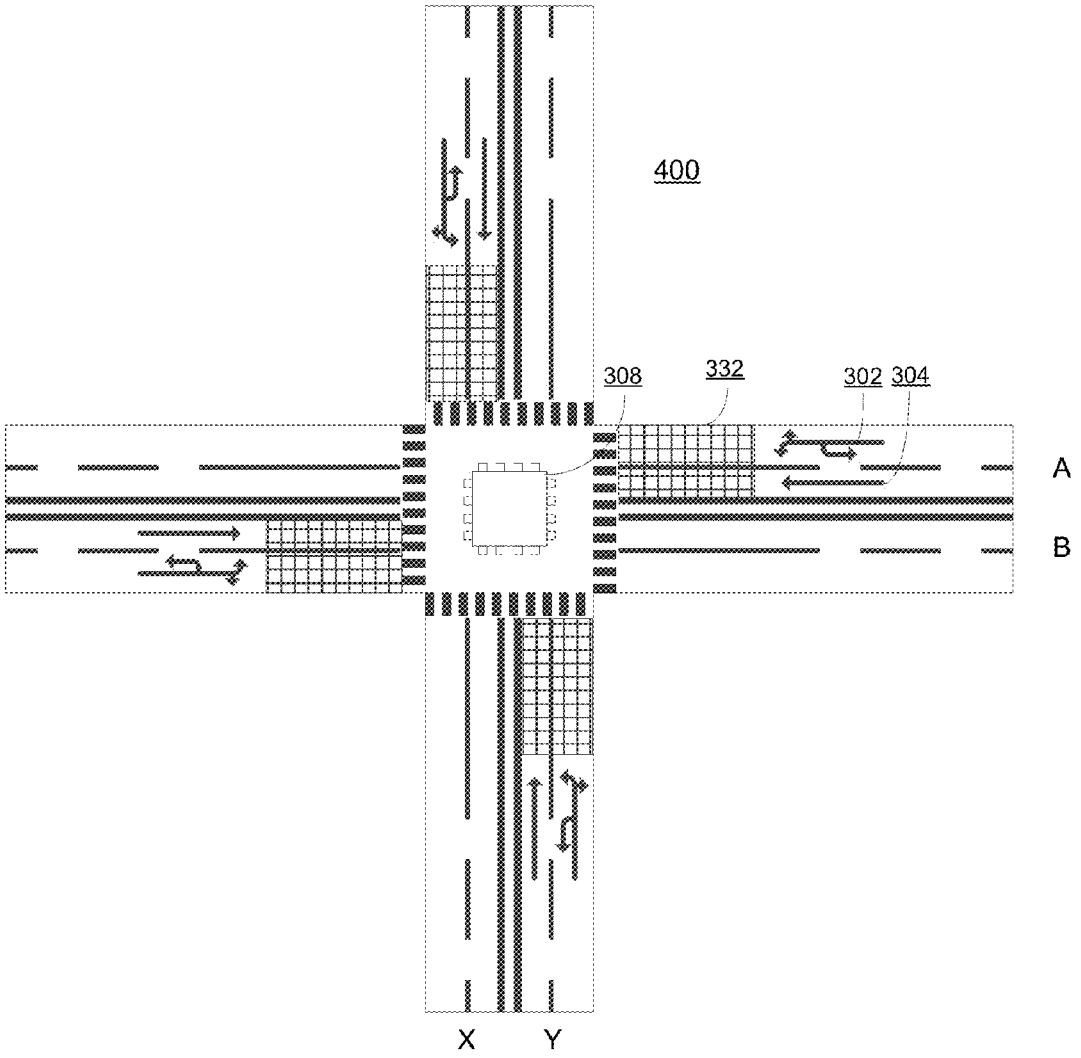
FIG. 16 illustrates another exemplary traffic system with a controlled zone consistent with the disclosed embodiments.

Returning to FIG. 11, additionally or optionally, traffic light system 308 may configure the light signals for traffic passing permit into two states, a stable state and a flashing state. Other number of states may also be used. The traffic light in the stable state is for all traffic; while the traffic light in the flashing state may only for traffic meeting certain condition(s). For example, a controlled zone may be allocated on each of the Road A, B, X, and Y such that the traffic light in the flashing state may be used together with the controlled zones to signal vehicles inside and/or outside individual controlled zones of Road A, B, X, and Y. FIG. 16 illustrates an exemplary traffic system 400 using controlled zones 332 and different traffic light states. The controlled zones may be painted in a color, such as yellow or white, to contrast with road surface.

As shown in FIG. 16, a controlled zone 332 is allocated on each of Road A, B, X, and Y connecting the intersection of Roads AB and XY. Traffic light signals may then be used together with the controlled zones 332. For example, the signal of green light may have two states, green light in stable state and green light in flashing state. The green light in the stable state is a green light for all vehicles and all vehicles are permitted to proceed, and the green light in the flashing state is still a green light but only vehicles in a corresponding controlled zone 332 are permitted to proceed, while vehicles not in the corresponding controlled zone 332 are required to stop behind controlled zone 332. In certain other embodiments, the vehicles may also stop behind the intersection under the green light in the flashing state.

Further, the signal of red light may have two states, red light in stable state and red light in flashing state. The red light in the stable state is a red light for all vehicles and all vehicles are required to stop, and the red light in the flashing state is still a red light but the signal of a flashing red light indicates that red light is going to turn to green light shortly and vehicles behind a corresponding controlled zone are required to enter the controlled zone 332 and be ready to pass the intersection when the green light is present. The length of the controlled zone 332 may be so configured that a vehicle entering the controlled zone 332 while red light flashes would not pass through the controlled zone 332 until the traffic light signal becomes green. Other configurations of the controlled zone 332 may also be used.

Figure 17:
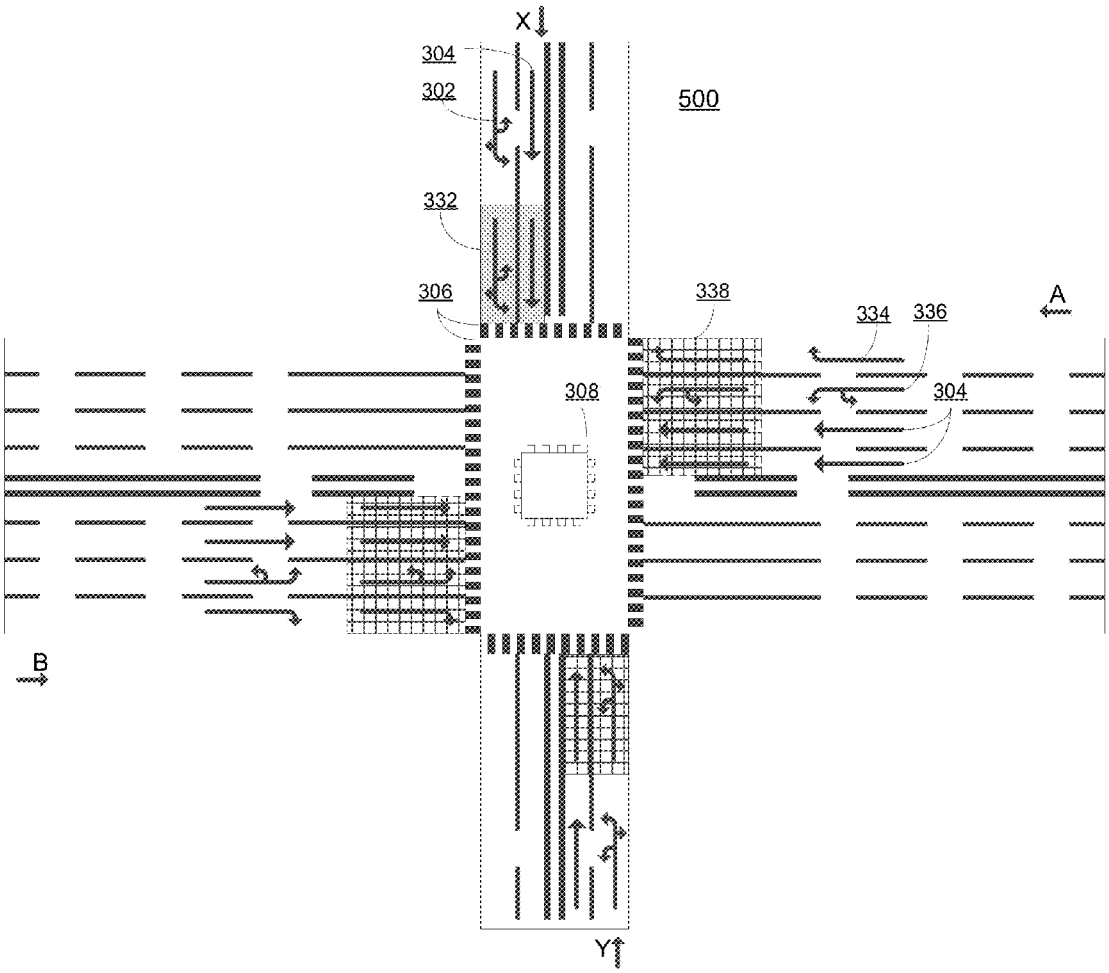
FIG. 17 illustrates another exemplary traffic system with the controlled zone consistent with the disclosed embodiment.
Figure 18:
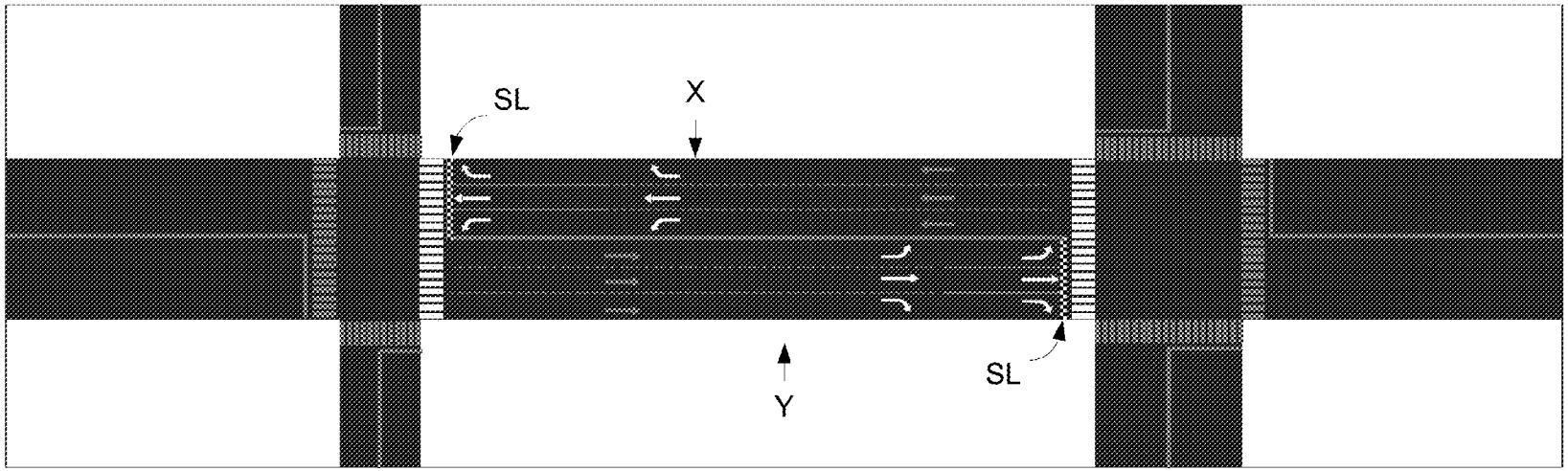
FIG. 18 illustrates a traditional arterial road organization.
Figure 19:
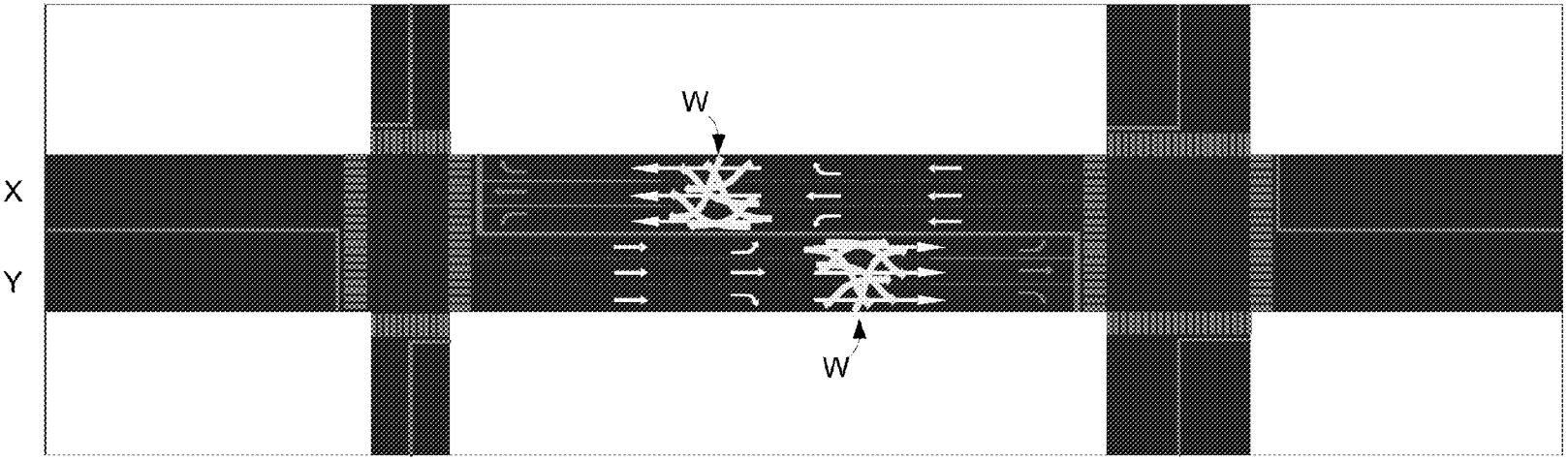
FIG. 19 illustrates the traffic weavings on a road with traditional road organization.
Figure 20:
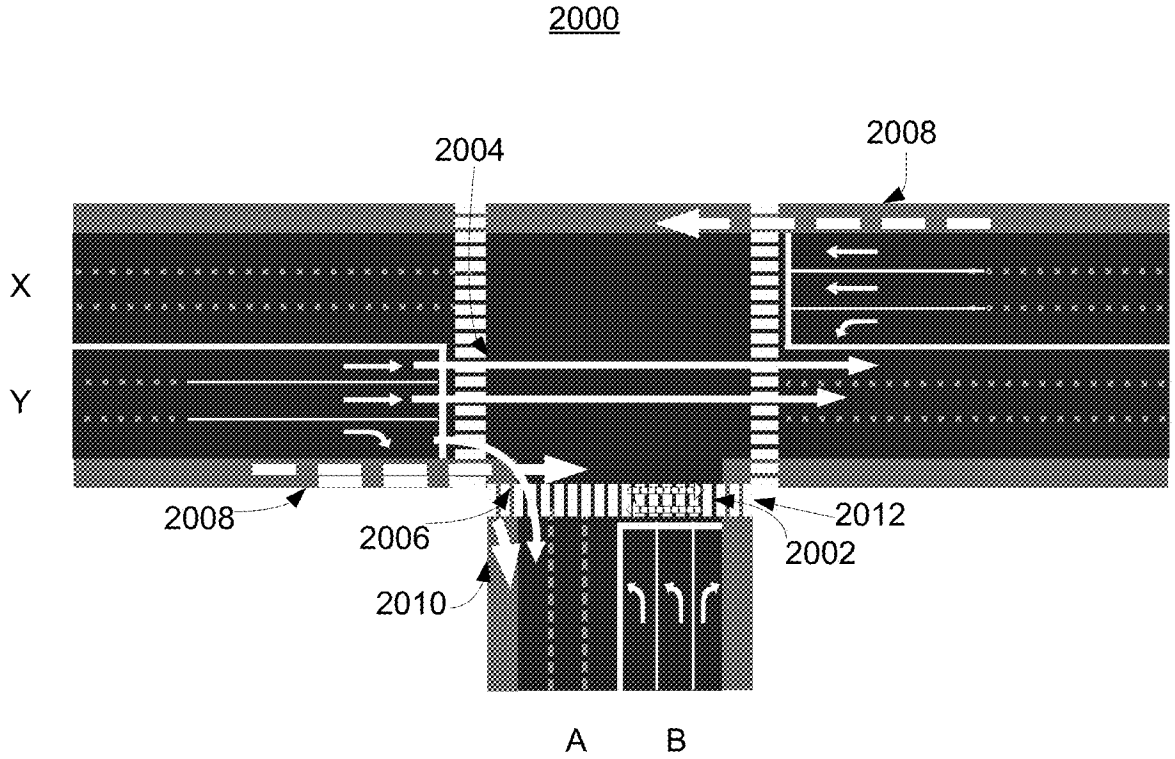
FIG. 20 illustrates the traffic movements in the first phase of a traditional system.
Figure 21:
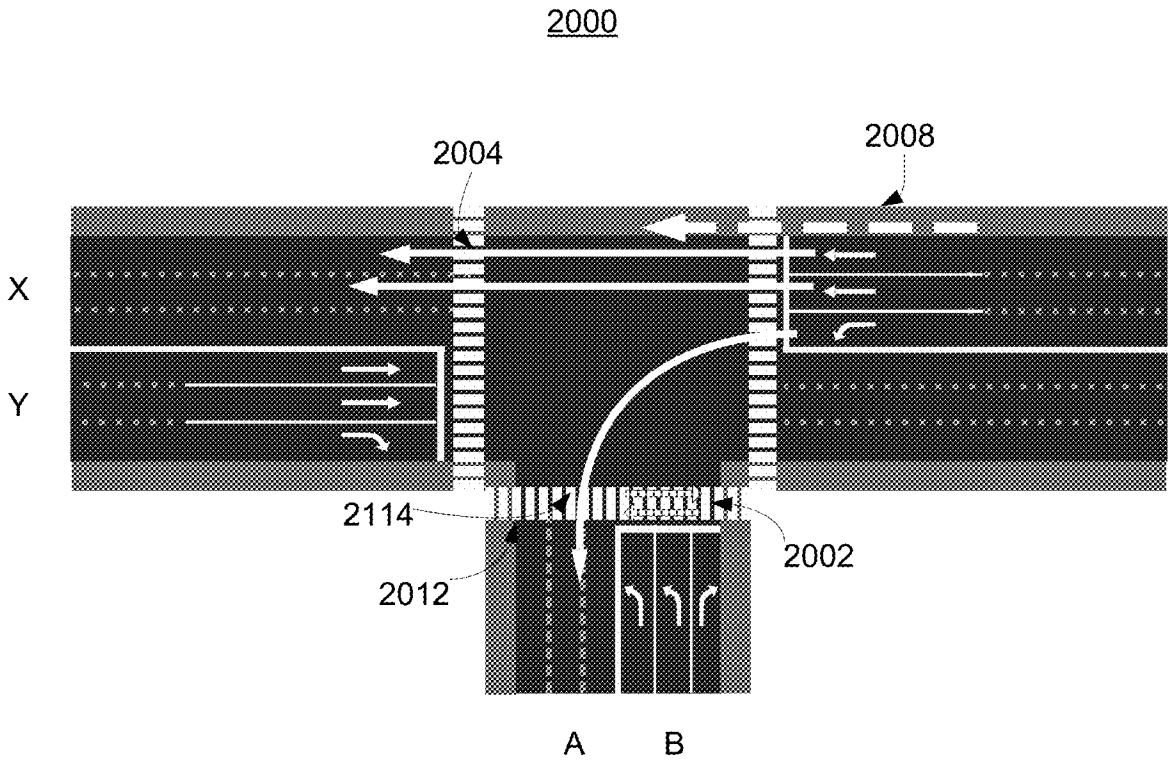
FIG. 21 illustrates the traffic movements in the second phase of a traditional system.
Figure 22:
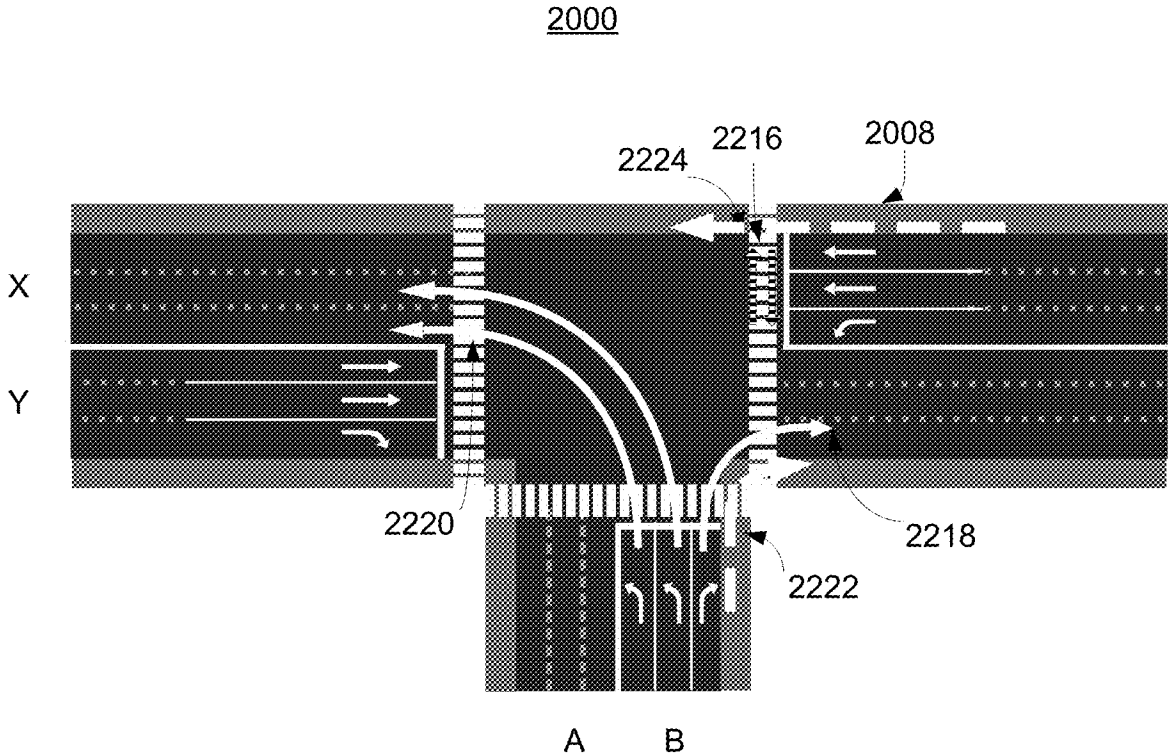
FIG. 22 illustrates the traffic movements in the third phase of a traditional system.

FIG. 17 illustrates another exemplary traffic system 500. As shown in FIG. 17, the traffic system 500 is similar to the traffic system 300 in FIG. 8. However, the Road A and Road B both include 4 lanes instead of two lanes. Any number of lanes may be included in Road A, B, X, and/or Y.

The traffic system 500 may include traffic light system 308, through traffic markings 304 on Roads A, B, X, and Y, turn traffic markings 302 on Roads X and Y, turn traffic markings 334 and 336 on Roads A and B, controlled zones 332 on Road XY; and controlled zones 338 on Road AB. Because Road AB has four lanes, the through traffic markings 304 are located at the inner two lanes of Road A and B, the right turn traffic marking 334 is located at the right lane (the outer-most lane) of Road A and B, and the left turn and U turn marking 336 is located at the second-outer-most lane. On the other hand, Road XY still has two lanes, the traffic markings on Road XY may remain unchanged from traffic system 300. That is, the turn marking 302, which combines right, left, and U turn markings, is located on the curb lane, and the through traffic marking 304 is located at the innermost lane.

Further, controlled zones 332 and 338 may be allocated at the end connected to the intersection on each of Road A, B, X, and Y. Each road may have two sets of through and turn traffic markings, with one set traffic markings in the controlled zone and the one set of markings on the road behind the controlled zone. Other configurations may also be used.

By using the disclosed methods and systems, advantageous traffic resource allocation systems may be implemented to control the traffic movements in an intersection and complete vehicle traffic needs may be supported. For example, vehicles can be permitted to make U turn at intersections, which is a great saving of time and journey compared the prohibition of U turn under traditional traffic resources allocation. Because there is no conflict between pedestrians and vehicles, all traffic participants may adopt reasonable high speed to pass at intersections.

The drivers of through lanes may be benefited from the disclosed methods and systems in that, when a through traffic is permitted, the permitted through lane is always clear ahead. Thus, the drivers of through lanes may enjoy a quicker passing. Pedestrians are also benefited from the disclosed methods and systems as pedestrians now facing no conflicts with turn traffic and the only moving vehicles are at distance of at least one lane away and such vehicles are moving at a parallel direction. Furthermore, the disclosed methods and systems add a controlled zone and vehicles may stop behind controlled zone which adds a large distance between pedestrians and vehicles. In addition, the disclosed methods and systems also support continuous green light therefore emergency vehicle may save substantial waiting time.

In other words, the disclosed methods and systems may offer certain advantages over the traditional system both in safety and efficiency through optimized allocation of space and time at an intersection. The pedestrian and vehicle through traffic on the same road may pass the intersection at the same time without interfering with each other, i.e., the pedestrian traffic and vehicle traffic are separated in space. As a result, the risk of collision between pedestrians and vehicles in the intersection is substantially reduced and both pedestrians and vehicles can pass the intersection with reasonable high speed. Further, the allocation of turn traffic to the lanes closer to the curb provides greater maneuver space for vehicles to turn at the intersection. U turn, therefore, is practical in most intersections, while in traditional system, U turn is generally impermissible on narrower roads. In addition, greater maneuver space means greater safety for the vehicle in motion.

Further, the allocation of controlled zones and the flashing light states increases the safety as well. The controlled zones may also provide extra distance between stopped vehicles and pedestrians in the cross walk. The flashing light may provide warning to the pedestrians and vehicles that the present traffic signal is about to expire and the pedestrians and vehicles are provided extra time to prepare for the next step of action.

Figure 23:
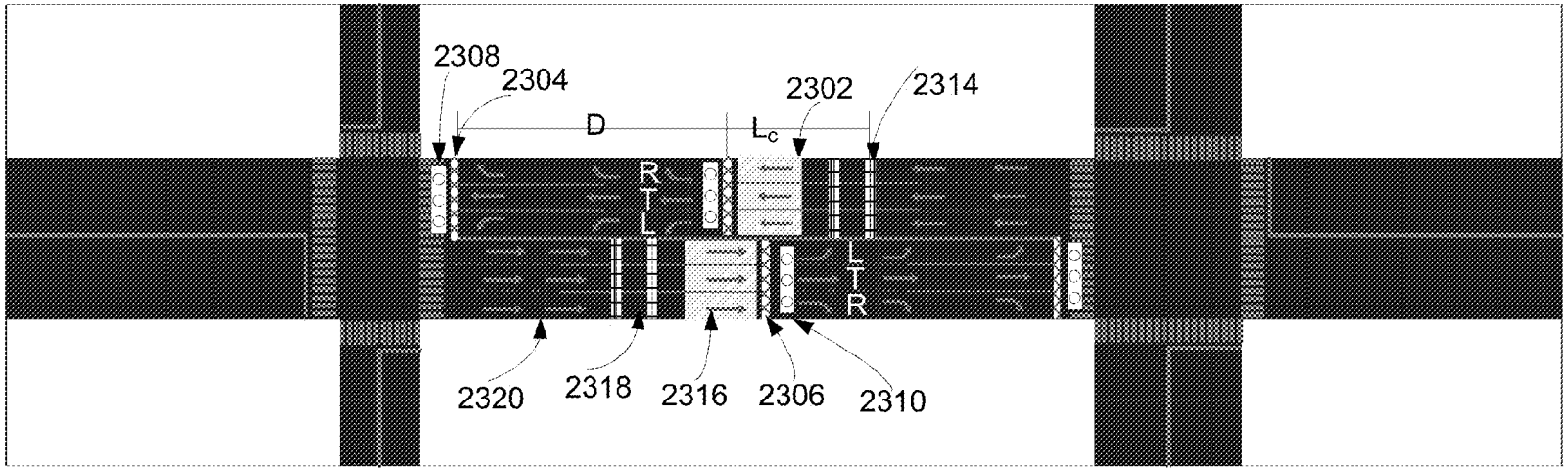
FIG. 23 illustrates an exemplary lane control system consistent with the disclosed embodiments.

FIG. 23 illustrates an exemplary lane control system 2300 consistent with the disclosed embodiments. As shown in FIG. 23, the lane control system 200 may include a control area 2302, a control line 2306, a stop line 2304, a first traffic light system 2310, and a second traffic light system 2308. The control area 2302 may be a space on the road that is located at a distance (D) from the stop line 2304. The system 2300 may further include one or more warning line 2314. The area between the front end of the control area 2302 and the first warning line 2314 may be designated as a first zone 2316. The area between the last warning line 2314 and the end of the first zone 2316 may be designated as a warning line zone 2318. The area behind the warning zone 2318 may be designated as a rear zone 2320.

The length ($L_c$) of the control area 2302 may be determined empirically. For example, the length $L_c$ of the control area 2302 may be configured for a vehicle to complete a safe stop with comfortable deceleration rate. The length $L_c$ of the control area 2302 may also be determined using any other appropriate method. The control area 2302 may be marked to distinguish with other area of the road. In certain embodiments, the control area 2302 may be painted yellow and designated as Signalized Yellow Zone (SYZ). The zone 2302 may also be painted using reflective material. Thus, the zone 2302 is recognizable under certain conditions, such as in the conditions that the visibility may be reduce due to weather or time of the day. Any other appropriate marking method may be used to identify the control area 2302.

The control area 2302 may also be located at a non-signalized intersection or crosswalk. In certain embodiment, the non-signalized control area 2302 may be painted yellow and designated as Open Yellow Zone (OYZ). Any other appropriate method may be used to identify the non-signalized control area 2302. In a non-signalized intersection or crosswalk, the system 2300 may not include the first traffic light system 2310 and/or the second traffic light system 2308.

The distance D may be determined empirically. For example, the distance D may be configured to allow a certain number of vehicles to queue when the light 2308 system does not permit vehicles to proceed into the intersection. The distance D may be determined by any other appropriate method.

The second traffic light system 2308 may be a traffic light system and the first light system 2310 may be a lane control light system. The timing of the light systems 2308 and 2310 may be coordinated to regulate the traffic on the road. The road may be divided into a through traffic lane (T), a right turn traffic land (R), and a left turn traffic lane (L). When the red light of the light system 2308 is on, the light system 2310 may be configured to allow the vehicle on certain lane to proceed the control line 2306, in which the vehicle may be required to choose a lane to proceed to the intersection. The other lanes in the control area may not permit other vehicle to proceed the control line 2306. Thus, the vehicle that has passed the control line 2306 may change lane with relative easiness because the neighbor lane may have a space free of other vehicle. For example, the light system 2310 may allow a vehicle on T lane to proceed the control line 2306. The vehicle may be required to choose a lane (T, R, or L) and, if the vehicle chooses R or L, complete the lane change while it has passed the control lane 2306. The traffic light systems 2308 and 2310 may be similar to the traffic light system 308 as shown in FIG. 9 with appropriate adjustment. For example, the number of traffic light set 316, and the number of the sensors 312 may be adjusted to fit the need of the systems 2308 and/or 2310. The traffic lights in the system 2308 and/or 2310 may include red, green, and yellow lights and the marking on the traffic light may be modified. The traffic signal in the system 2308 and/or 2310 may be generated by any appropriate means. For example, the signal may be generated automatically based on a program, may be generated based on the information received by a sensor similar to the sensor 312, or may be generated by a traffic control person.

After exiting the control area 2302 and transferring to the desired lane, the vehicle may proceed to queue in front of the light system 2308. When the green light on the light system 2308 is turned on, the vehicle in the area between the stop line 2304 and control line 2306 may be located in a lane corresponding to the direction the vehicle is going. Thus, during the red light interval of the light system 2308, the vehicles on the road may proceed under the control of the light system 2310 to enter the desired lane. After the green light of the system 2308 is turned on, the vehicles between the stop line 2304 and the control line 2306 have already on the desired lane and do not need to change lanes again. As a result, the weaving on the road may be significantly reduced.

The timing of the light systems 2308 and 2310 may also be coordinated to reduce the violation of running red light. In certain embodiments, the green light interval of light systems 2308 and 2310 may overlap but may not be identical. For example, the overlapping between the light system 2308 and 2310 may be about 60% to 70% of a green light interval. The overlapping time may be adjusted and determined empirically. Under the coordinated timing, all lanes behind the traffic lights system 2310 may be closed a few seconds (a first advanced time) before the yellow or red signals of the traffic system 2308 are turned on. The first advanced time may be adjusted and determined empirically. During the first advanced time, the vehicles between the stop line 2304 and control line 2306 are allowed to proceed to enter the intersection and pass through. When the red light on the system 2310 is turned on, the space between the stop line 2304 and control line 2306 may be substantially clear of vehicle. If any vehicle fails to pass the intersection for any reason, such vehicle may simply stay and wait for next green light signal. Such vehicle may also complete the lane change as described above.

When the light system 2308 is in red light state, the system 2310 may turn on green light at a second advanced time to allow the vehicles behind the second stop line 2304 to proceed the control line 2306. After passing the control line 2306, the vehicles may make a lane choice and perform the lane change at the second advanced time.

Under the coordinated timing of the traffic light systems 2308 and 2310, violations of running red light of one system is still possible. However, such violation has different consequence compared to the violation of red light signal under traditional system. As described above, the traffic lights of the lane control light system 2310 controls traffic behind the control line 2306. A violation of the traffic lights of the system 2310 is a failure to obey lane control. Thus, the most serious safety issue, a violation of running red light under traditional system has been transformed into a lane control compliance issue.

In other words, a violation of red light of the traffic light system 2310 would result in minor safety concern because the vehicle violating the rule enters the control area 2302 along the same direction as other rule obeying vehicles. A collision is less likely to occur. Even if a collision does occur, the consequence is less serious because colliding vehicles are traveling on the same direction and the speed difference is likely to be minor. After passing the red light of the system 2310, a rule violating vehicle is much more likely to stop at a second red light, namely, the red light of the system 2308. By contrast, a vehicle violating a red light rule in a traditional system would likely collide with pedestrians or another vehicle traveling along a cross direction at a relatively high speed.

The system 2300 may also be used to reduce the stops at an intersection. A vehicle often stops a plurality of times before it has the opportunity to enter and pass the intersection. During rush hour, the problem of frequent stopping at an intersection becomes more pronounced due to the drastic drop in operating speed, which may lead to a drastic drop in traffic capacity. For example, during non-rush hour, the normal traffic capacity may be 1,600 cars per hour per lane. At rush hours, the traffic capacity may drop by half to 800 cars per hour per lane or even less due to the low speed traffic. A reinforcing circle is likely to form. Significant speed loss leads to significant capacity loss; then significant traffic capacity loss leads to further significant speed loss. Thus, traffic congestion is likely to occur sooner or later. At signalized intersections, traffic control may choose to extend the duration of green light time to increase the traffic capacity of certain phase(s). However, extending the duration of green light time of one phase will likely result in the excessive delay of other phases. Thus, traffic congestion is still likely to occur, longer or shorter.

The system 2300 may be activated to a stopping reducing state when the operating speed on the road is reduced to a pre-determined threshold speed, for example, 30 kilometers per hour (km/hr). The threshold speed may be adjusted and determined empirically. At the stopping reducing state, the traffic light system 2310 may stop all the vehicles behind the stop line 2306 for a pre-determined waiting time period. The waiting time period may be adjusted and determined empirically. After the waiting time period, vehicles may be permitted to pass through the intersection. The vehicles may be able to pass the intersection at a reasonably high speed. Thus, the number of stops may be reduced and accordingly, gasoline consumption/pollution could be effectively reduced. Furthermore, drivers may use the waiting time for certain tasks such as making a phone call or sending a message (if this is legal), which is a difficult under present traffic and such action is indeed both dangerous and illegal in many states. Since the waiting time could be utilized and also the waiting time is more likely to be predictable, drivers would experience less frustration and feel less uncertainty.

When the system 2300 is in a stop reducing state, the light system 2310 may stop traffic on one or more lanes while allowing vehicles on other lanes to proceed.

The system 2300 may also be utilized to facilitate the operation of public vehicles, such as ambulance, bus, police vehicle, or any other public vehicles. In certain embodiments, the light system 2310 may stop the vehicles in one or more lanes while permitting the public vehicles to run on other lanes.

Figure 24:
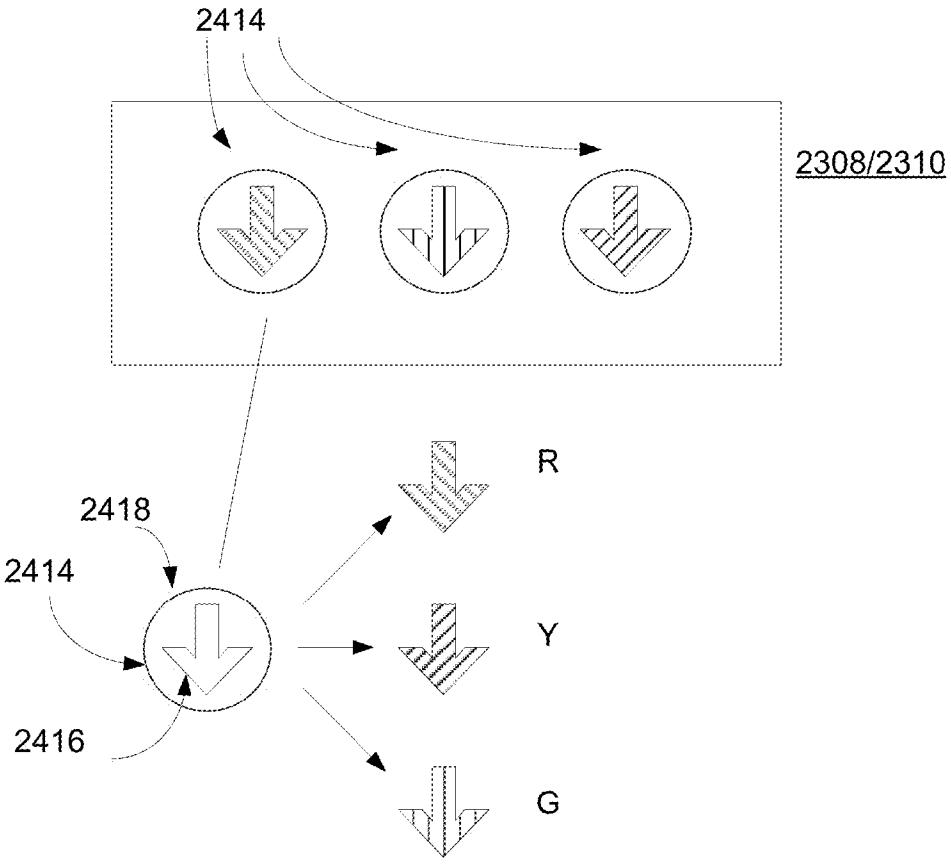
FIG. 24 illustrates an exemplary traffic light system consistent with the disclosed embodiments.

FIG. 24 illustrates an exemplary traffic light system 2308 or 2310 consistent with the disclosed embodiments. Each traffic light 2414 may correspond to a lane to regulate the traffic thereon. The traffic light 2414 may take any appropriate format to direct the traffic on each lane. In certain embodiments, as shown in FIG. 24, the system 2308 or 2310 may include a traffic light 2414. The light 2414 may include a color arrow 2416 within a background circle 2418. The arrow 2416 may be programmed to be in the color of red (R), yellow (Y), and green (G). The coloring of the arrow 2416 may be achieved by any appropriate methods. For example, the color may be shown by turn on a corresponding colored light within the light 2414.

Thus, each traffic light may control the proceeding of the vehicles in each corresponding lane. For example, in the example shown in FIG. 24, the left arrow 2414 is in the color of red, the middle arrow 2414 is in the color of green, and the right arrow 2414 is in the color of yellow. Accordingly, the vehicles on the left lane are stopped and queue behind the stop line 2304 or 2306, the vehicles on the middle lane are permitted to proceed, and the vehicles on the right lane are permitted to proceed with caution, usually under a predetermined speed limit, such as 30 km/hr.

Figure 25A:
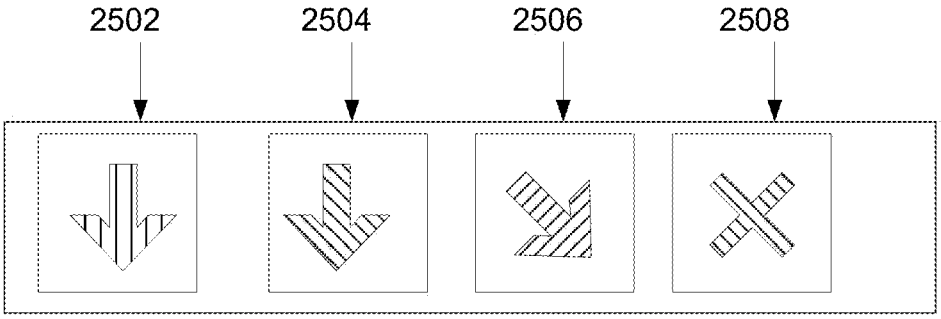
FIG. 25A illustrates exemplary traffic lights consistent with the disclosed embodiments.

The traffic light 2414 may take any appropriate format to direct the traffic on each lane. FIG. 25A illustrates exemplary traffic lights consistent with the disclosed embodiments. As shown in FIG. 25A, a light 2502 is in the color of green indicating that the lane is open. A light 2504 is in the color of red (R) indicating that vehicle is required to stop and queue. A light 2506 is in the color of yellow (Y) and pointing to a direction indicating the lane is closed ahead and the vehicle should change to the lane as directed. A light 2508 is an "X" mark in the color of red indicating that the lane is closed. Any other appropriate methods may be used. It has been widely believed that it is risky to stop vehicles at high speed safely and smoothly, such as vehicles on freeway, multiway or arterial road. Thus, the stop and queue function in the traditional system is difficult to implement. With the control line 2306, the control zone 2302 and the lane control light 2504, it becomes relatively safe to do so in the system 2300.

Figure 25B:
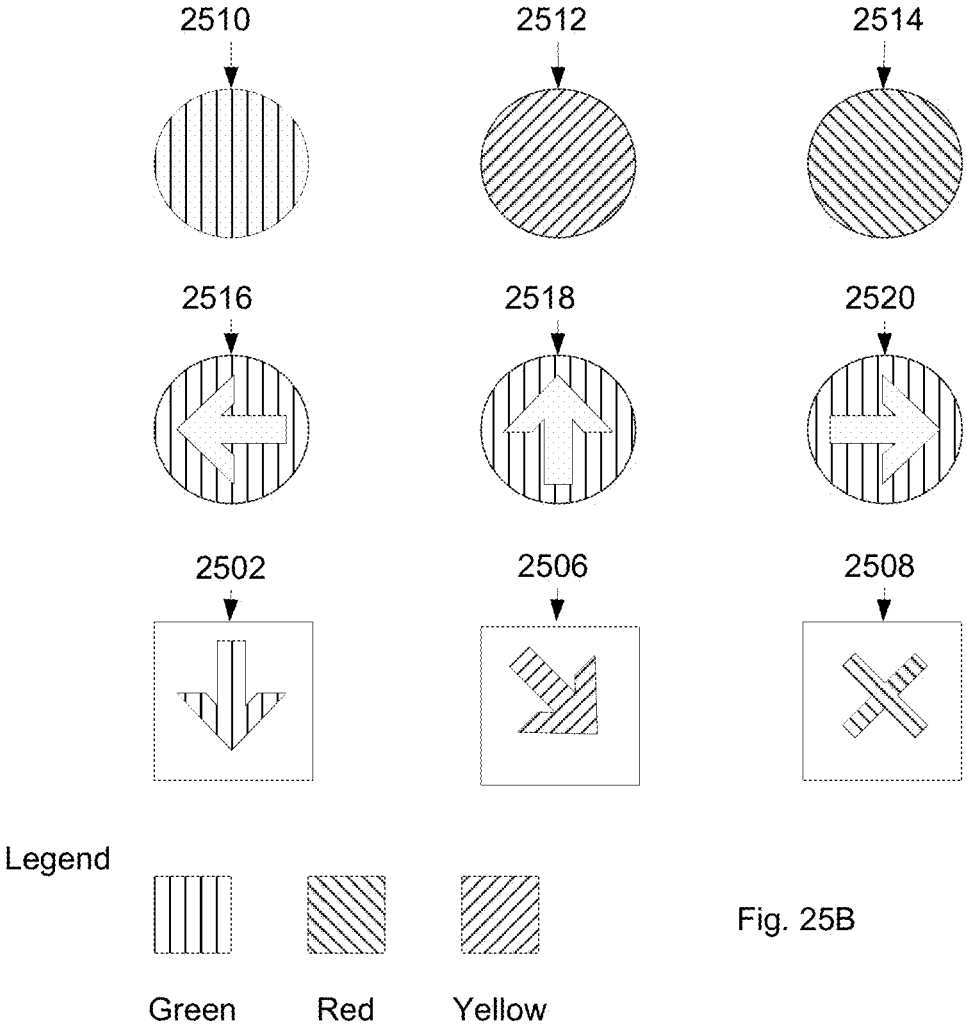
FIG. 25B illustrates traffic lights under traditional system.

As a comparison, FIG. 25B illustrates the traffic lights under a traditional system. As shown in FIG. 25B, the traditional system may include a green light 2510, a yellow light 2512, and a red light 2514. The traditional system at an intersection may include a light with an arrow indicating the direction of the traffic, such as a left arrow green light 2516, an up arrow green light 2518, and a right arrow green light 2520. The traditional system may also include a lane control light, such as the light 2502, the light 2506, and the light 2508.

To solve an extremely complicated problem like the problem of dilemma zone, there are two possible approaches. The first one is to entirely avoid the problem and the second one is to effectively mitigate the effects of the problem, if the problem could not be avoided. In the case of the problem of dilemma zone, the first approach is to optimize traffic signal programming so all vehicles could successfully pass an intersection before the end of green interval. And the problem of dilemma zone could be entirely avoided since no driver near an intersection would see the signal of yellow light at all. Meanwhile, the second approach is, when a yellow light starts, to provide effective assistance to help drivers make a proper decision immediately.

Accordingly, to satisfactorily solve the problem of dilemma zone, it is critical to provide valid assistance to vehicle drivers when the signal light of yellow light is starting, then drivers could make a proper decision immediately with confidence. Briefly, vehicle drivers shall be assisted at the onset of yellow light, rather than just being warned.

Furthermore, to satisfactorily solve the problem of dilemma zone, it is critical that vehicles shall be stopped from entering the dilemma zone after the onset of yellow light. To be more precise, after the onset of yellow light, vehicles shall be stopped from entering the dilemma zone with a high speed.

Figure 26A:
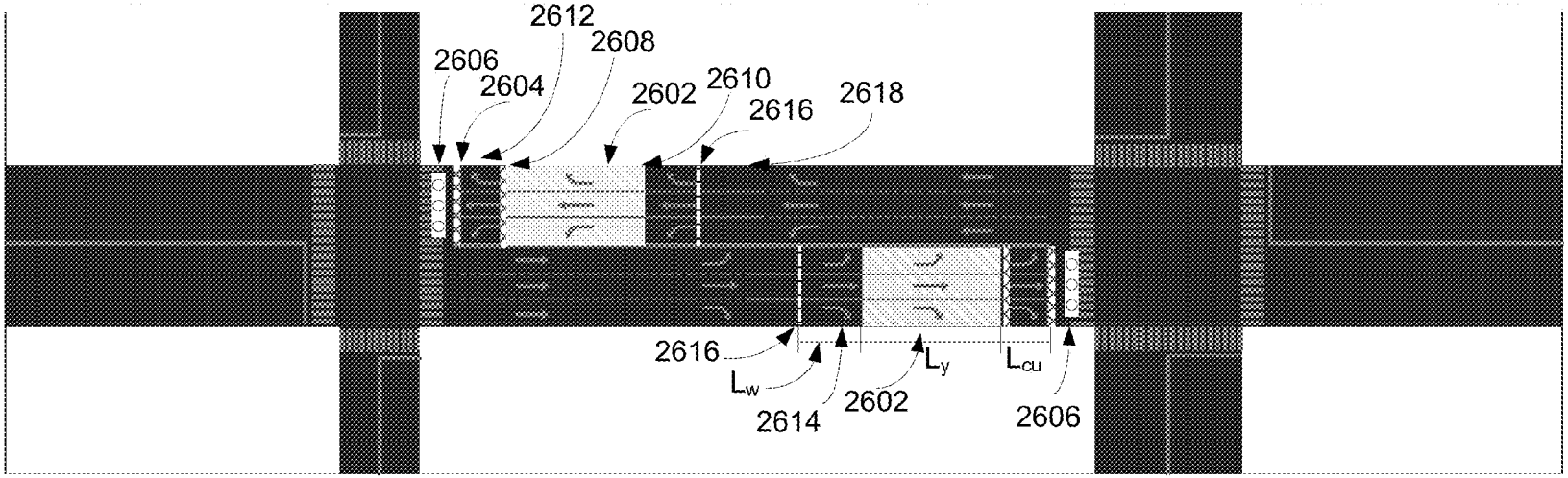
FIG. 26A illustrates an exemplary yellow light system consistent with the disclosed embodiments.

FIG. 26A illustrates an exemplary yellow light system 2600 consistent with the disclosed embodiments. As shown in FIG. 26, the system 2600 may include a yellow light control zone 2602, a stop line 2604, a traffic light system 2606, a control line 2608 located at the front border of the zone 2602, and a rear border 2610 of the zone 2602. The road may be divided into four zones, a cushion zone 2612 between the stop line 2604 and the control line 2608, the yellow light control zone 2602, a warning line zone 2614 behind the rear border 2610 and before the warning line 2616, and a rear zone 2618 behind the warning line 2616.

The system 2600 may be used to assist the decision making for a driver facing a yellow light. The control zone 2602 may have a length $L_y$. The length $L_y$ may be adjusted and determined empirically. In certain embodiments, the length $L_y$ may be determined by two factors: the length of the yellow light signal and the speed limit. Once the length of the yellow light signal is determined, the Length $L_y$ may be a function of the speed limit. A longer length $L_y$ may correspond to a higher speed limit. In certain embodiments, the length $L_y$ may be configured to allow a vehicle traveling at the speed limit stop within the control zone within the length of the yellow light signal. That is, if a vehicle with a speed at the speed limit arrives at the rear border 2610 and stops when the yellow light is on, the vehicle may be stopped before it reaches the control line 2608. The length $L_y$ may be configured to have other appropriate value. In certain embodiments, the length $L_y$ may be between 20 meters to 60 meters. The length $L_y$ may have other appropriate value.

The cushion zone 2612 may have a length $L_{cu}$. The length $L_{cu}$ may be adjusted and determined empirically. In certain embodiments, the length $L_{cu}$ may be determined by the distance a vehicle needs to stop completely from a pre-determined speed. For example, a vehicle may start braking at the rear border 2610 when the yellow light is on. Assuming the vehicle is traveling at the speed limit and the driver applies the brake with moderate force, the vehicle may reach a pre-determined speed when it reaches the control line 2608. The length $L_{cu}$ may be determined to allow the vehicle to stop completely before stop line 2604 if the driver continues to apply the brake in a similar manner. The length $L_{cu}$ may be determined using any appropriate methods.

The yellow light control zone 2602 may be identified by any appropriate methods. In certain embodiments, the zone 2602 may be painted in yellow. The zone 2602 may also be painted using reflective material. Thus, the zone 2602 is recognizable under certain conditions, such as in the conditions that the visibility may be reduce due to the weather, such as fog, rain, or snow, or the night. Correspondingly, when the visibility is reduced, the traffic light system 2606 may turn on a flashing yellow light to impose a predetermined speed limit.

When the traffic light system 2606 starts a yellow light, a vehicle in the rear zone 2618 is required to stop. A vehicle in the warning light zone 2614 is suggested to stop. A vehicle in the control zone 2602 may proceed or stop, but be suggested to proceed. A vehicle in the cushion area 2612 is required to proceed to enter and pass the intersection. When the yellow light of the light system 2606 is already on, a vehicle in the warning line zone 2614 and the rear zone 2618 is required to stop. A vehicle in the control zone 2602 is suggested to stop. A vehicle in the cushion area 2612 may proceed to enter and pass the intersection under Permissive yellow rule. Thus, due to the length $L_y$ of the zone 2602 and the time of the yellow light, any vehicle that is required or chooses to proceed may pass the intersection safely without the violation of running red light. The vehicle that is required or chooses to stop may stop before the stop line 2604 safely and properly.

The system 2300 may also assist a driver's decision making during a yellow light period. Referring to FIG. 23, when the yellow light period of the traffic light system 2310 is starting, the vehicles in the first zone 2316 may be suggested to proceed to the control line 2306. The vehicles in the warning line zone 2318 may be suggested to stop behind the control line 2306. The vehicles in the rear zone 2320 may be required to stop behind the control line 2306. The light system 2310 may be coordinated with the light system 2308 to facilitate the vehicles behind the control line 2306, to stop safely behind the second stop line 2304. For example, the yellow light of the light system 2308 may flash to caution the vehicles in the rear zone 2320 to reduce speed.

Figure 26B:
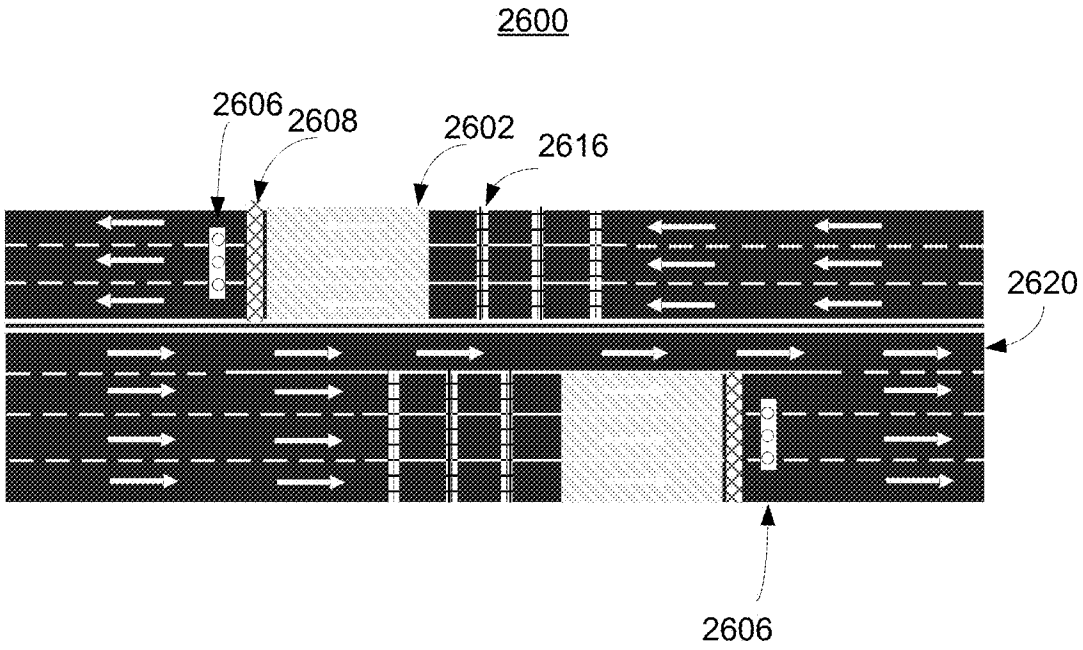
FIG. 26B illustrates an exemplary yellow light system consistent with the disclosed embodiments.

The system 2600 may also be used on the road where it may be necessary to control the stopping frequency. FIG. 26B illustrates an exemplary system 2600 consistent with the disclosed embodiments. As shown in FIG. 26B, the system 2600 may be implemented at a non-intersection location. When the operation speed on the road is reduce to a pre-determined threshold, the system 2600 may be activated to reduce the frequency of the stop on the road. The light system 2606 may stop the traffic behind the control line 2608 for a period of time. The stopping time may be adjusted and determined empirically. When the vehicles behind the stop line 2608 are allowed to resume running, there may be a larger space before the vehicles and then the vehicles may reach a reasonably high speed for a reasonably long time period. The system 2600 may also include a designated lane 2620. The lane 2620 may be used by vehicles with special permit to travel thereon. For example, the lane 2620 may be used by bus, emergency vehicles, car pool vehicles, or any other vehicles that obtain a special permit.

Figure 26C:
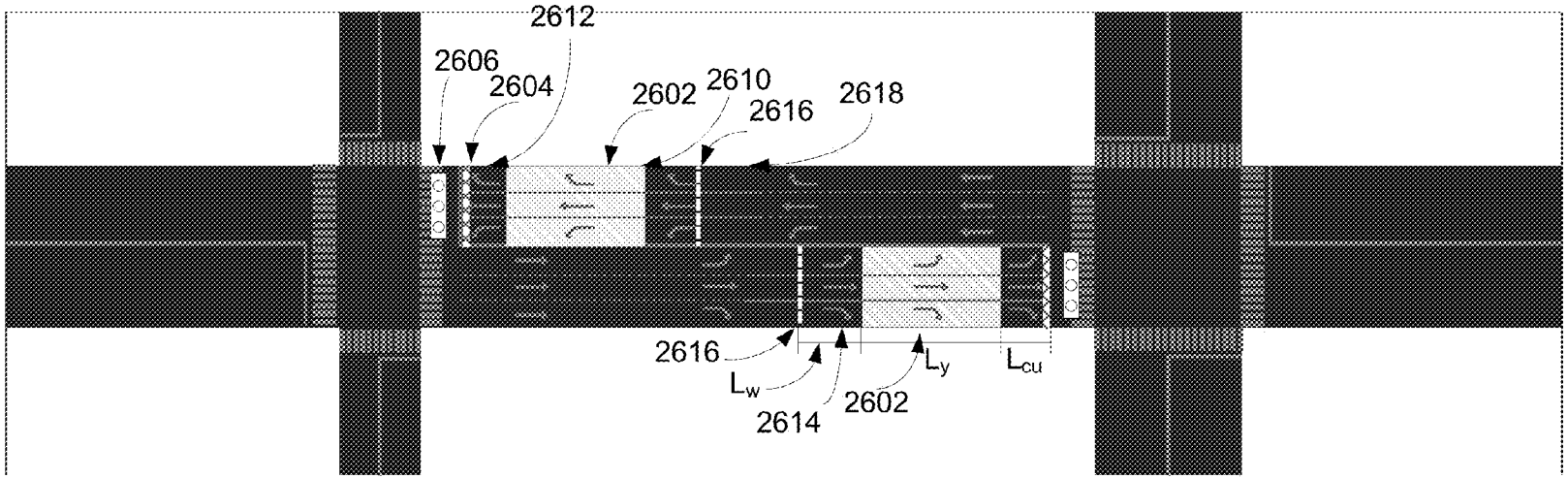
FIG. 26C illustrates an exemplary yellow light system consistent with the disclosed embodiments.

In certain embodiments, the system 2600 may be implemented without the control line 2608. As shown in FIG. 26C, the system 2600 may include the stop line 2604, the traffic light system 2606, the control zone 2602, and other components of the system 2600, but not the control line 2608. The same rules described above for traffic control during a yellow light period of an intersection apply in the system 2600 without the control line.

Figure 27:
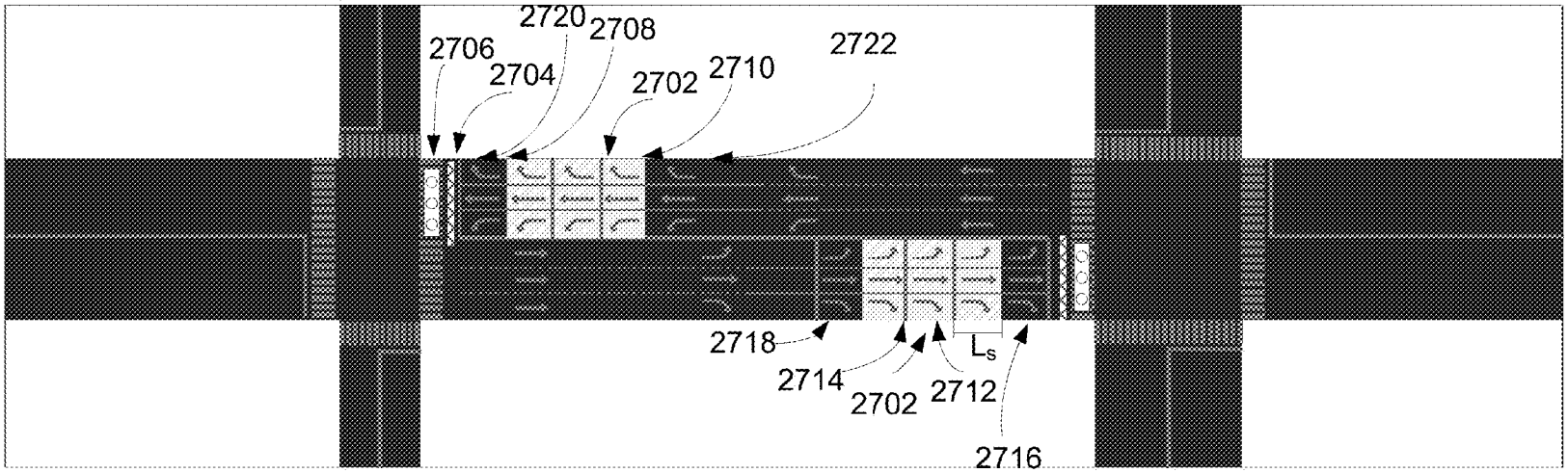
FIG. 27 illustrates an exemplary traffic control system consistent with the disclosed embodiments.

FIG. 27 illustrates an exemplary traffic control system 2700 consistent with the disclosed embodiments. As shown in FIG. 27, the system 2700 may include a yellow light control zone 2702, a stop line 2704, a traffic light system 2706, a front border 2708 of the zone 2702, and a rear border 2710 of the zone 2702. The zone 2702 may be divided into one or more stop box 2712 by adding one or more dividing line 2714 within the zone 2702. The system 2700 may also include a cushion zone stop box 2716 and a rear stop box 2718.

At signalized intersection, when a green light is on, it often takes substantial "response time" for vehicles to reach a relatively high speed for a static state. Normally, the first four or five vehicles take longer response time and the vehicles behind them may move as a relatively free flow.

The system 2700 may be used to reduce the response time and hence increase the ratio of effective green light time, and accordingly, also increase traffic capacity. As shown in FIG. 27, the yellow light control zone 2702 may be divided into one or more stop box 2712. There may also be stop box 2716 in a cushion zone 2720 and rear stop box 2718 in a rear zone 2722. Each stop box 2712, 2716, or 2718 may have a length $L_s$. The length $L_s$ for different stop box 2712 may or may not be the same. The length $L_s$, which may be a function of the speed limit, may be adjusted and determined empirically. In certain embodiments, the length $L_s$ is longer in a stop box 2712, 2716 or 2718 closer to the stop line 2704. The length $L_s$ is configured to allow the vehicle within the stop box 2712 to reach a pre-determined speed. In certain embodiments, the length $L_s$ may be about 10 meters or longer. The length $L_s$ may have other value.

When the red light of the traffic light 2706 is on, vehicles stop and queue behind the stop line 2704. In the system 2700, for the first several vehicles, each vehicle with a length below a pre-determined value stops within a stop box 2712, 2716, or 2718 and each stop box 2712, 2716, or 2718 may not have more than one vehicle. A vehicle with a length over a pre-determined value, such as a truck, a bus, or any other vehicle that is relatively long, may be allowed to occupy more than one stop box 2712, 2716, or 2718. In certain embodiments, the vehicle is required to stop close to the rear dividing line 2714. When the green light of the traffic light 2706 is on, the vehicles in the stop boxes 2712, 2716, or 2718 may start substantially simultaneously because of the length $L_s$ of each stop box. That is, the stop box 2712, 2716, or 2718 separate two vehicles, a front one and a rear one, to a certain distance because of the length $L_s$ of each stop box. The front vehicle and the rear vehicle may start simultaneously without the risk of collision. By contrast, under traditional system, a rear vehicle usually has to wait for a short interval time after the front vehicle starts to avoid potential collision.

Figure 28:
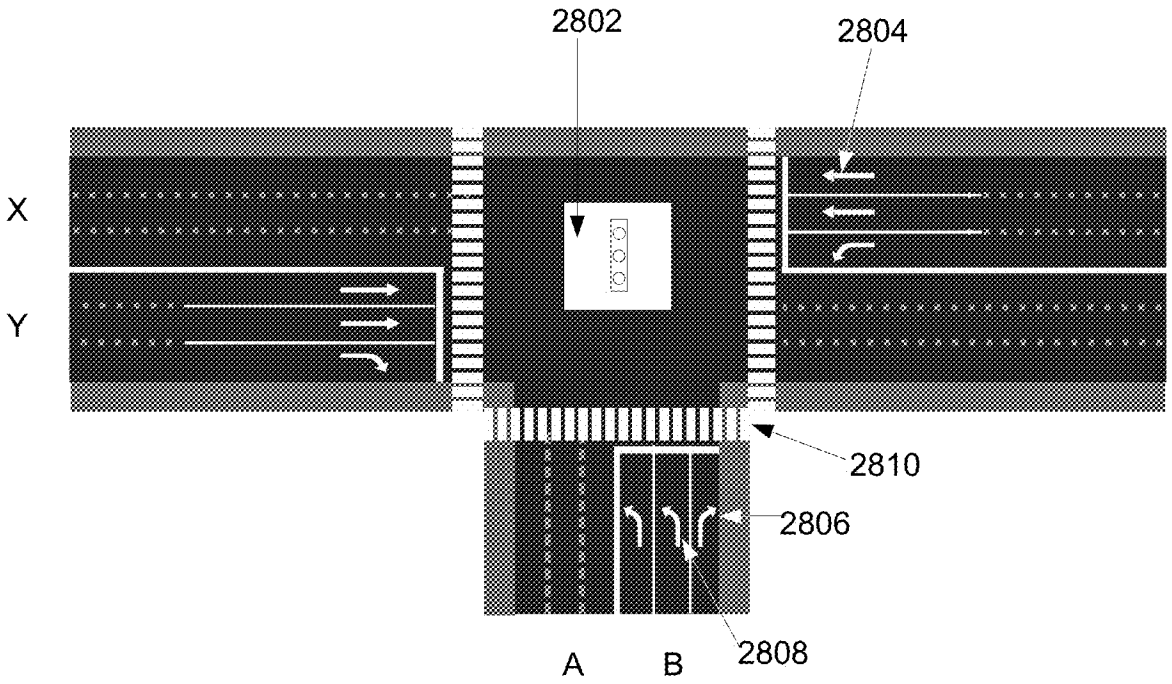
FIG. 28 illustrates an exemplary traffic system consistent with the disclosed embodiments.

FIG. 28 illustrates an exemplary traffic system 2800 consistent with the disclosed embodiments. As shown in FIG. 28, the traffic system 2800 is provided in an intersection where the Roads AB and XY intersect to form a "T" junction. The traffic system 2800 includes a traffic light system 2802, which may include three sets of traffic lights facing the roads B, X, and Y. The traffic system 2800 may also include a traffic space allocation system, which may include through traffic marking 2804, right turn traffic marking 2806, and left turn marking 2808 on roads B, X, and Y, and markings on pedestrian cross line 2810.

The traffic system 2800 may also includes a passing permit allocation system, such as a traffic light system 2802. The traffic light system 2802 may be similar to the traffic light system 308 as shown in FIG. 9 with appropriate adjustment. For example, the number of traffic light set 316, and the number of the sensors 312 may be adjusted to fit the need of the systems 2802. The traffic light in the system 2802 may include red, green, and yellow lights and the marking on the traffic light may be modified. The traffic signal in the system 2802 may be generated by any appropriate means. For example, the signal may be generated automatically based on a program, may be generated based on the information received by a sensor similar to the sensor 312, or may be generated by a traffic control person.

The traffic light system 2802 may be controlled by controller 310 or controlling center 314 to implement a three-phase traffic passing permit allocation. FIG. 29 illustrates an exemplary three-phase traffic passing permit allocation system in a "T" intersection. The three phases of traffic passing permit allocation is also called a traffic allocation cycle. As shown in FIG. 29, each traffic direction is represented by a two letter code. The first letter of the code represents the road on which the traffic is moving from. The second letter of the code represents the direction of the traffic, with "L" meaning left turn, "R" meaning right turn, and "T" meaning through traffic. For example, BL means the left turn traffic from road B, and XT means the through traffic on road X.

According to the traffic system 2800, all traffic participants may be classified into three basic types, through traffic, right turn traffic, and left turn traffic. Traffic system 2800 may control the three types of traffic such that, at a given phase, there may not be conflicting traffic type.

As shown in FIG. 29, the traffic passing permit allocation system uses three phases to control traffic movements in the "T" intersection. Different number of phases may also be used in a single traffic allocation cycle. The first phase is allocated to the vehicle through traffic and pedestrian traffic on roads X and Y. The second phase is allocated to the vehicle turn through traffic on roads X and B. The third phase is allocated to the vehicle turn traffic on road Y and B. The order of the three phases may be changed. The details of each traffic allocation phase are described below.

Figure 30:
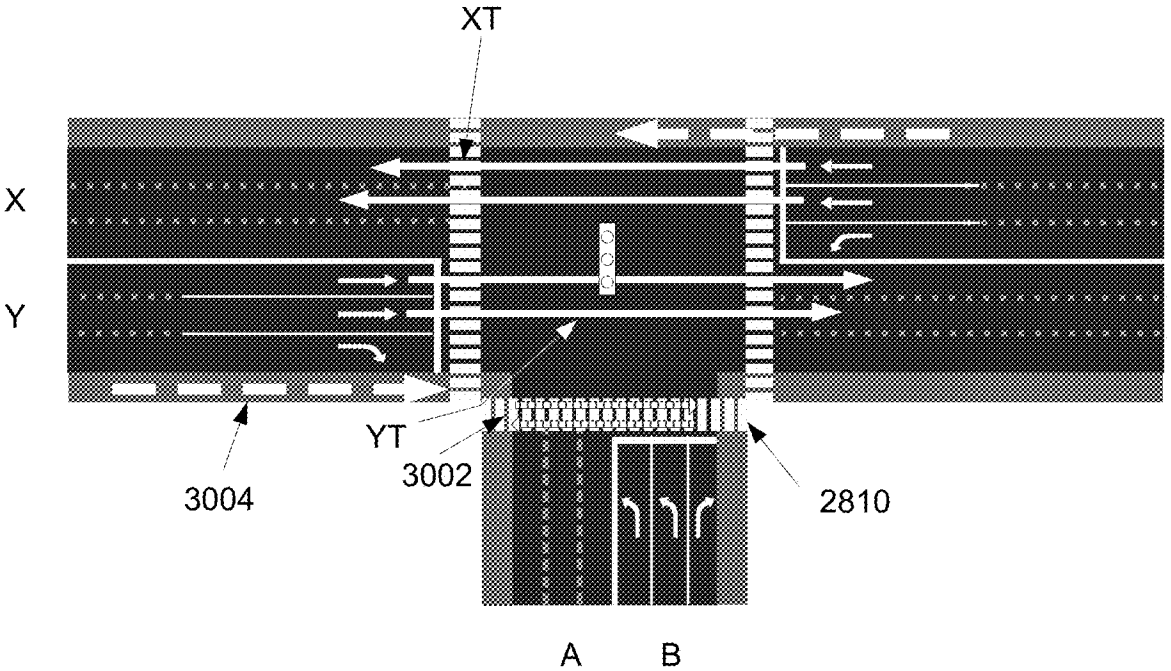
FIG. 30 illustrates the traffic movement of the first phase of an exemplary traffic passing permit allocation system.

FIG. 30 illustrates the traffic movement of the first phase of an exemplary traffic passing permit allocation system. As shown in FIG. 30, during the first phase, the vehicle through traffic XT and YT, the pedestrian traffic 3002 along the roads X and Y, and the bicycle through traffic 3004 proceed without interference from other traffic. Other vehicle traffics, such as turn traffic on both roads B, X and Y, are not permitted. The pedestrian traffic 3002 is permissible along the whole length of the pedestrian cross lines 2810 along road XY from both directions.

Figure 31:
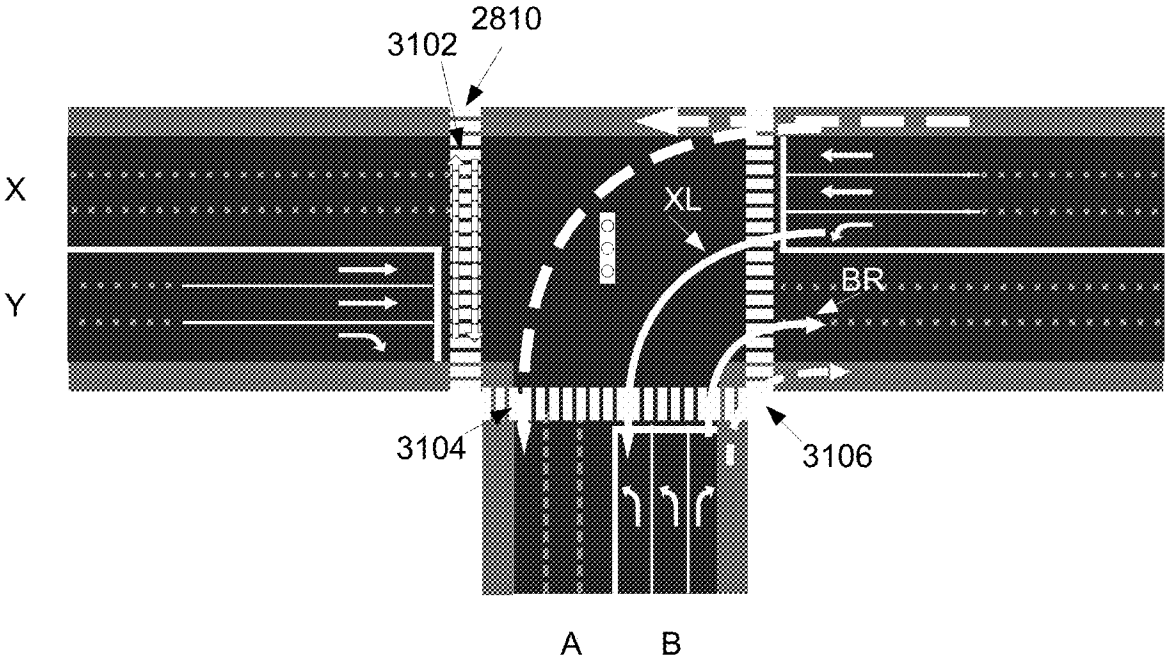
FIG. 31 illustrates the traffic movement of the second phase of an exemplary traffic passing permit allocation system.

FIG. 31 illustrates the traffic movement of the second phase of an exemplary traffic passing permit allocation system. As shown in FIG. 31, during the second phase, the vehicle left turn traffic XL from road X and right turn traffic BR from road B, the pedestrian traffic 3102 along road A, and bicycle left turn traffic 3104 from road X, and bicycle right turn traffic 3106 from road B proceed without interference from other traffic. Other traffics, such as the through traffic on roads X and Y, are not permitted. The pedestrian traffic 3102 is permissible along the whole length of the pedestrian cross lines 2810 along road A from both directions.

Figure 32:
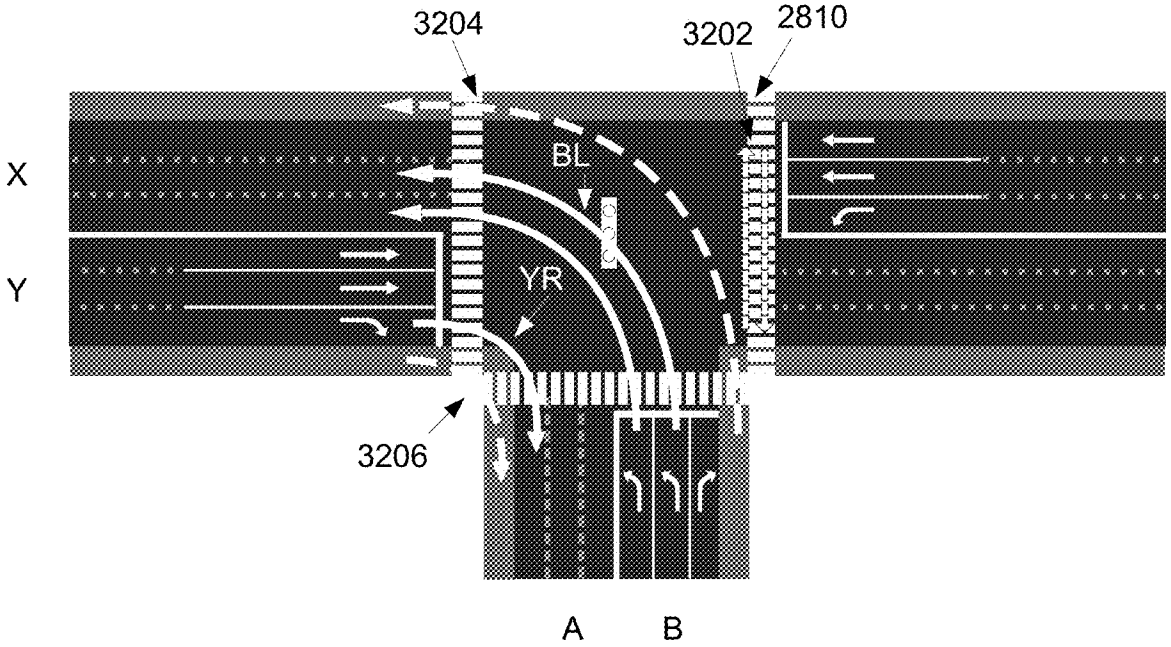
FIG. 32 illustrates the traffic movement of the third phase of an exemplary traffic passing permit allocation system.

FIG. 32 illustrates the traffic movement of the third phase of an exemplary traffic passing permit allocation system. As shown in FIG. 32, during the third phase, the vehicle right turn traffic YR from road Y and left turn traffic BL from road B, the pedestrian traffic 3202 along road B, and bicycle left turn traffic 3204 from road B, and bicycle right turn traffic 3206 from road Y proceed without interference from other traffic. Other traffics, such as the through traffic on roads X and Y, are not permitted. The pedestrian traffic 3202 is permissible along the whole length of the pedestrian cross lines 2810 along road B from both directions.

By using the disclosed methods and systems, advantageous traffic resource allocation systems may be implemented to control the traffic movements in an intersection and complete vehicle traffic needs may be supported. For example, vehicles may pass an intersection with a reasonably high speed. The efficiency of the road system may be improved.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications. For example, the traffic system according to the present disclosure can be used signalized crosswalks where traffic are controlled by traffic lights; the traffic system according to the present disclosure can also be used in road spaces near toll stations where traffic are controlled by lane control light.

What is claimed is:

1. A traffic lane control method for controlling lane traffic, comprising:

dividing a road into one or more lanes;

providing a control line with a lane control light system;

providing a control area with a pre-determined length after the control line in the direction of the traffic;

controlling a traffic movement on the road by permitting a vehicle on one or more lanes to pass the control line to enter the control area and prohibiting a vehicle on other lane to pass the control line to enter the control area;

requiring vehicles entering the control area to make traffic direction decision and corresponding lane choice decision and complete lane choice in the control area before reaching the stop line, wherein:

each lane behind the stop line is assigned to one of the through, left turn, and right turn traffic.

2. The method of claim 1, wherein the lane traffic is around an intersection, further including:

providing a stop line close to the intersection with a traffic control light system, the control area located between the control line and the stop line and at a pre-determined distance from the stop line.

3. The method of claim 2, further including:

requiring vehicles to proceed to queue behind the stop line after completing the lane choice while the traffic control light system stops the traffic behind the stop line.

4. The method of claim 2, further including:

stopping the traffic behind the control line on one or more lanes at a first advanced time before stopping the traffic behind the stop line to allow the vehicles between the control line and the stop line to pass the intersection.

5. The method of claim 2, further including:

resuming the traffic behind the control line on one or more lanes at a second advanced time, while prohibiting traffic on other lanes behind the control line from entering the control area, wherein:

the vehicles entering the control area are required to make traffic direction, decision and corresponding lane choice decision and complete lane choice in the control area before reaching to a stop line.

6. The method of claim 2, when the road operation speed is below a pre-determined threshold, further including:

stopping the traffic behind the control line on one or more lanes for a pre-determined time period; and permitting vehicles to start from behind the control line on one or more lanes and passing the intersection.

7. The method of claim 2, wherein:

one or two of the traffic light system and the lane control light system is configured to have one traffic light directing the traffic on one lane.

8. The method of claim 2, wherein:

a traffic light is configured to instruct a vehicle to stop and queue behind one or two of the control line and stop line.

9. The method of claim 4, further including:

requiring the vehicles, that are located between the control line and the stop line during the first advance time and fail to proceed beyond the stop line to pass the intersection, to stop behind the stop line.

10. A method for controlling traffic, comprising:

providing a cushion zone with a first pre-determined length, a control zone with a second pre-determined length, and a rear zone on a road, the cushion zone being closest to a stop line and the rear zone being farthest to the stop line, wherein a traffic on the road traveling from the rear zone to the stop line;

instructing vehicles to make the passing decision according to their locations, wherein, when a yellow light is starting, vehicles in the cushion zone are required to pass the stop line;

vehicles in the control zone are suggested to pass the stop line; and vehicles in the rear zone are required to stop behind the stop line.

11. The method of claim 10, further including:

providing a warning line zone between the control zone and the rear zone by providing a warning line behind a rear border of the control zone.

12. The method of claim 11, wherein the traffic is around an intersection, the stop line located closest to the intersection, while a yellow light period is starting, further including:

requiring vehicles in the cushion zone to pass the intersection;

suggesting vehicles in the control zone to pass the intersection;

suggesting vehicles in the warning line zone to stop; and requiring vehicles in the rear zone to stop.

13. The method of claim 11, wherein the traffic is around an intersection, the stop line located closest to the intersection, while a yellow light period has already started, further including:

suggesting vehicles in the cushion zone to pass the intersection;

suggesting vehicles in the control zone to stop; and requiring vehicles in the warning line zone and rear zone to stop.

14. The method of claim 10, wherein:

the first pre-determined length and the second pre-determined length are a function of a speed limit of the road, wherein higher speed limit leads to longer pre-determined length.

15. A method for controlling traffic behind a stop line, including:

providing a cushion zone with a first pre-determined length, a control zone with a second pre-determined length, and a rear zone on a road, the cushion zone being closest to a stop line and the rear zone being farthest to the stop line, wherein a traffic on the road traveling from the rear zone to the stop line;

providing one or more stop box with a pre-determined stop box length behind the stop line on the road with the traffic approaching the stop line;

requiring a vehicle with a length below a pre-determined value to occupy a stop box, which permits only one vehicle to occupy, while a red light in the traffic light system is on;

permitting vehicles in the stop box to start substantially simultaneously when the traffic on the road is permitted to resume.

16. The method of claim 15, wherein:

the stop box closer to the stop line has longer pre-determined stop box length.

17. The method of claim 15, wherein:

the vehicle is required to stop closer to a rear dividing line of the stop box.

18. A traffic resource allocation method for allocating traffic resources around a T shaped intersection formed by a first road and a second road, wherein the second road ends at the junction of the first road and the second road, the method comprising:

dividing the first road into two or more first lanes at a first direction and two or more second lanes at a second direction opposite but parallel to the first direction, the first direction being further from the second road;

assigning one or more first lanes furthest from the second road as through traffic lane;

assigning one or more first lanes closer to the second road as left turn lane;

assigning one or more second lanes furthest from the second road as through traffic lane;

assigning one or more second lanes closer to the second road as right turn lane;

dividing the second road into two or more third lanes at a third direction and two or more fourth lanes at a fourth direction opposite but parallel to the third direction third direction being toward the intersection;

assigning one or more innermost lanes of third direction as left turn lane;

assigning one or more outermost lanes of third direction as right turn lane; and controlling traffic movements in the intersection by allocating traffic passing permit to pedestrian traffic and vehicle traffic on the first road and the second road, wherein, when pedestrian traffic along the first direction and the second direction is permitted, through vehicle traffic along the first direction and the second direction is permitted, and turn traffic at any of the first, second, and third directions is prohibited;

when vehicle left turn traffic from the first direction and vehicle right turn traffic from the third direction are permitted, the pedestrian traffic at the third and fourth direction is permitted, and any other vehicle traffic is prohibited, and the left turn traffic from the first direction and the right turn traffic from the third direction are opposite; and when vehicle right turn traffic from the second direction and vehicle left turn traffic from the third direction, pedestrian traffic at the third and fourth direction is permitted, any other vehicle traffic is prohibited, and the right turn traffic from the second direction and the left turn traffic from the third direction are opposite.

19. The method of claim 18, further including:

allocating traffic passing permit to a bicycle traffic, wherein the permit to bicycle traffic is the same to the permit to vehicle traffic.

* * * * *